US011867436B2

(12) United States Patent
Clodic et al.

(10) Patent No.: US 11,867,436 B2
(45) Date of Patent: Jan. 9, 2024

(54) METHOD FOR EXCHANGING HEAT IN VAPOR COMPRESSION HEAT TRANSFER SYSTEMS AND VAPOR COMPRESSION HEAT TRANSFER SYSTEMS COMPRISING INTERMEDIATE HEAT EXCHANGERS WITH DUAL-ROW EVAPORATORS OR CONDENSERS

(71) Applicant: THE CHEMOURS COMPANY FC, LLC, Wilmington, DE (US)

(72) Inventors: Denis Clodic, Palaiseau (FR); Youssef Riachi, El Khenchara (LB); Mary E Koban, Chadds Ford, PA (US)

(73) Assignee: THE CHEMOURS COMPANY FC, LLC, Wilmington, DE (US)

( * ) Notice: Subject to any disclaimer, the term of this patent is extended or adjusted under 35 U.S.C. 154(b) by 0 days.

(21) Appl. No.: 18/084,201

(22) Filed: Dec. 19, 2022

(65) Prior Publication Data

US 2023/0235930 A1 Jul. 27, 2023

Related U.S. Application Data

(60) Division of application No. 15/939,644, filed on Mar. 29, 2018, now Pat. No. 11,624,534, which is a (Continued)

(30) Foreign Application Priority Data

Dec. 17, 2007 (WO) ..... PCT/US2007/025675

(51) Int. Cl.
*F25B 40/02* (2006.01)
*F25B 40/00* (2006.01)
(Continued)

(52) U.S. Cl.
CPC ..... *F25B 40/02* (2013.01); *F25B 40/00* (2013.01); *F25B 49/027* (2013.01);
(Continued)

(58) Field of Classification Search
None
See application file for complete search history.

(56) References Cited

U.S. PATENT DOCUMENTS 3,877,242 A 4/1975 Creager
4,230,470 A 10/1980 Matsuda et al.
(Continued)

FOREIGN PATENT DOCUMENTS

EP 1764574 B1 2/2009
GB 2405688 A 3/2005
JP 2003021432 A 1/2003

OTHER PUBLICATIONS

Barbara Minor et al., HFO-1234yf Low GWP Refrigerant Update, International Refrigeration and Air Conditioning Conference at Purdue, Jul. 14-17, 2008, pp. 1-8.
(Continued)

*Primary Examiner* — Brian M King

(57) ABSTRACT

A multi-step method is disclosed for exchanging heat in a vapor compression heat transfer system having a working fluid circulating therethrough. The method includes the step of circulating a working fluid comprising a fluoroolefin to an inlet of a first tube of an internal heat exchanger, through the internal heat exchanger and to an outlet thereof. Also disclosed are vapor compression heat transfer systems for exchanging heat. The systems include an evaporator, a compressor, a dual-row condenser and an intermediate heat exchanger having a first tube and a second tube. A disclosed system involves a dual-row condenser connected to the first and second intermediate heat exchanger tubes. Another
(Continued)

disclosed system involves a dual-row evaporator connected to the first and second intermediate heat exchanger tubes.

21 Claims, 2 Drawing Sheets

Related U.S. Application Data continuation of application No. 13/207,557, filed on Aug. 11, 2011, now abandoned, which is a continuation-in-part of application No. 12/119,023, filed on May 12, 2008, now abandoned.

(60) Provisional application No. 60/928,826, filed on May 11, 2007, provisional application No. 60/988,562, filed on Nov. 16, 2007.

(51) Int. Cl.
*F28D 1/053* (2006.01)
*F28D 1/04* (2006.01)
*F25B 49/02* (2006.01)
*F28D 21/00* (2006.01)

(52) U.S. Cl.
CPC ..... *F28D 1/0452* (2013.01); *F28D 1/05333* (2013.01); *F28D 1/05383* (2013.01); *F28D 1/05391* (2013.01); *F25B 2339/046* (2013.01); *F25B 2400/121* (2013.01); *F28D 2021/007* (2013.01); *F28D 2021/0071* (2013.01)

(56) References Cited

U.S. PATENT DOCUMENTS 4,316,366 A 2/1982 Manning
4,774,813 A 10/1988 Yokoyama et al.
5,271,473 A 12/1993 Ikeda et al.
5,529,116 A 6/1996 Sasaki et al.
5,987,907 A 11/1999 Morimoto et al.
6,021,846 A 2/2000 Sasaki et al.
6,176,102 B1 1/2001 Novak et al.
6,327,866 B1 12/2001 Novak et al.
6,564,567 B2 5/2003 Skupin et al.
7,448,228 B2 11/2008 Han
7,448,436 B2 11/2008 Katoh et al.
2003/0024692 A1* 2/2003 Wu ..... F28D 1/0435 165/115
2004/0206490 A1 10/2004 Katoh et al.
2004/0244411 A1* 12/2004 Ichimura ..... F28D 7/10 165/154
2005/0011637 A1 1/2005 Takano
2005/0050910 A1 3/2005 Moon et al.
2006/0022166 A1 2/2006 Wilson et al.
2006/0032244 A1* 2/2006 Tomlinson ..... F25B 39/04 62/115
2006/0196225 A1 9/2006 Han
2006/0243944 A1* 11/2006 Minor ..... A62D 1/0057 252/67
2006/0243945 A1 11/2006 Minor et al.
2007/0039350 A1* 2/2007 Takeuchi ..... F25B 41/00 62/500
2007/0062678 A1 3/2007 Hayashi et al.
2007/0100175 A1 5/2007 Miller et al.
2007/0108403 A1 5/2007 Sievert et al.
2007/0289317 A1* 12/2007 Minor ..... C09K 5/045 252/68
2008/0230738 A1 9/2008 Minor et al.
2009/0314015 A1 12/2009 Minor et al.
2010/0012302 A1 1/2010 Clodic et al.
2018/0231281 A1 8/2018 Clodic et al.

OTHER PUBLICATIONS

Barbara Minor et al., HFO-1234yf Performance in a Beverage Cooler, International Refrigeration and Air Conditioning Conference at Purdue, Jul. 12-15, 2010, pp. 1-6.
Bukola O. Bolaji, Theoretical analysis of the energy performance of three low global warming potential hydro- fluorocarbon refrigerants as R134a alternatives in refrigeration systems, Journal of Power and Energy 2014, pp. 56-63, vol. 228(1), Sage Publications Ltd.—Abstract Only.
Hickman, Kenneth E., Alternatives to High GWP HFC Refrigerants: Chiller Applications, 2012 ASHRAE/NIST Refrigerants Conference, 2012.
Jeanneaux et al., Journal of Fluorine Chemistry, vol. 4, pp. 261-270, 1974.
McLinden, et al., Limited options for low-global-warming-potential refrigerants, Nature Communications, Jul. 1, 2016.
PCT International Search Report dated Jul. 23, 2008 for International Application No. PCT/US2007/025675.
PCT International Search Report dated Mar. 10, 2009.
PCT Partial International Search Report dated Dec. 12, 2008.
Pham et al., Lower-GWP Refrigerants in Refrigeration, 2012 ASHRAE/NIST Refrigerants Conference, 2012.

* cited by examiner

METHOD FOR EXCHANGING HEAT IN VAPOR COMPRESSION HEAT TRANSFER SYSTEMS AND VAPOR COMPRESSION HEAT TRANSFER SYSTEMS COMPRISING INTERMEDIATE HEAT EXCHANGERS WITH DUAL-ROW EVAPORATORS OR CONDENSERS

CROSS REFERENCE TO RELATED APPLICATIONS

This application is a division of and claims the priority benefit of pending U.S. patent application Ser. No. 15/939,644, filed Mar. 29, 2018, which is a continuation of U.S. patent application Ser. No. 13/207,557, filed Aug. 11, 2011, which is a continuation-in-part of U.S. patent application Ser. No. 12/119,023, filed May 12, 2008, which claims the priority benefit of U.S. Provisional Application No. 60/988,562, filed Nov. 16, 2007 and U.S. Provisional Application No. 60/928,826, filed May 11, 2007, and PCT Application No. PCT/US2007/025675, filed Dec. 17, 2007.

BACKGROUND OF THE INVENTION

1. Field of the Invention

The present disclosure relates to a method for exchanging heat in a vapor compression heat transfer system. In particular, it relates to use of an intermediate heat exchanger to improve performance of a vapor compression heat transfer system utilizing a working fluid comprising at least one fluoroolefin.

2. Description of Related Art

Methods for improving the performance of heat transfer systems, such as refrigeration systems and air conditioners, are always being sought, in order to reduce cost of operation of such systems.

When new working fluids for heat transfer systems, including vapor compression heat transfer systems, are being proposed it is important to be able to provide means of improving cooling capacity and energy efficiency for the new working fluids.

SUMMARY OF THE INVENTION

Applicants have found that the use of an internal heat exchanger in a vapor compression heat transfer system that uses a fluoroolefin provides unexpected benefits due to sub-cooling of the working fluid exiting out of the condenser. By "subcooling" is meant the reduction of the temperature of a liquid below that liquid's saturation point for a given pressure. The saturation point is the temperature at which the vapor usually would condense to a liquid, but subcooling produces a lower temperature vapor at the given pressure. By cooling a vapor below the saturation point, the net refrigeration capacity can be increased. Sub-cooling thereby improves cooling capacity and energy efficiency of a system, such as vapor compression heat transfer systems, which comprise fluoroolefins.

In particular, when the fluoroolefin 2,3,3,3-tetrafluoropropene (HFC-1234yf) is used as the working fluid, surprising results have been achieved with respect to coefficient of performance and capacity of the working fluid, as compared to the use of known working fluids such as 1,1,1,2-tetrafluoroethane (HFC-124a).

Therefore, in accordance with the present invention, the present disclosure provides a method of exchanging heat in a vapor compression heat transfer system, comprising:

(a) circulating a working fluid comprising a fluoroolefin to an inlet of a first tube of an internal heat exchanger, through the internal heat exchanger and to an outlet thereof;

(b) circulating the working fluid from the outlet of the first tube of the internal heat exchanger to an inlet of an evaporator, through the evaporator to evaporate the working fluid into a gas, and through an outlet of the evaporator;

(c) circulating the working fluid from the outlet of the evaporator to an inlet of a second tube of the internal heat exchanger to transfer heat from the liquid working fluid from the condenser to the gaseous working fluid from the evaporator, through the internal heat exchanger, and to an outlet of the second tube;

(d) circulating the working fluid from the outlet of the second tube of the internal heat exchanger to an inlet of a compressor, through the compressor to compress the working fluid gas, and to an outlet of the compressor;

(e) circulating the working fluid from the outlet of the compressor to an inlet of a condenser and through the condenser to condense the compressed working fluid gas into a liquid, and to an outlet of the condenser;

(f) circulating the working fluid from the outlet of the condenser to an inlet of the first tube of the intermediate heat exchanger to transfer heat from the liquid from the condenser to the gas from the evaporator, and to an outlet of the second tube; and (g) circulating the working fluid from the outlet of the second tube of the internal heat exchanger back to the evaporator.

The fluoroolefin is a compound selected from the group consisting of:

(i) fluoroolefins of the formula E- or Z—$R^1CH{=}CHR^2$, wherein $R^1$ and $R^2$ are, independently, $C_1$ to $C_6$ perfluoroalkyl groups;

(ii) cyclic fluoroolefins of the formula cyclo-[CX=CY$(CZW)_n$—], wherein X, Y, Z, and W, independently, are H or F, and n is an integer from 2 to 5; and (iii) fluoroolefins selected from the group consisting of: 1,2,3,3,3-pentafluoro-1-propene ($CHF{=}CFCF_3$), 1,1,3,3,3-pentafluoro-1-propene ($CF_2{=}CHCF_3$), 1,1,2,3,3-pentafluoro-1-propene ($CF_2{=}CFCHF_2$), 1,2,3,3-tetrafluoro-1-propene ($CHF{=}CFCHF_2$), 2,3,3,3-tetrafluoro-1-propene ($CH_2{=}CFCF_3$), 1,3,3,3-tetrafluoro-1-propene ($CHF{=}CHCF_3$), 1,1,2,3-tetrafluoro-1-propene ($CF_2{=}CFCH_2F$), 1,1,3,3-tetrafluoro-1-propene ($CF_2{=}CHCHF_2$), 1,2,3,3-tetrafluoro-1-propene ($CHF{=}CFCHF_2$), 3,3,3-trifluoro-1-propene ($CH_2{=}CHCF_3$), 2,3,3-trifluoro-1-propene ($CHF_2CF{=}CH_2$), 1,1,2-trifluoro-1-propene ($CH_3CF{=}CF_2$), 1,2,3-trifluoro-1-propene ($CH_2FCF{=}CF_2$), 1,1,3-trifluoro-1-propene ($CH_2FCH{=}CF_2$), 1,3,3-trifluoro-1-propene ($CHF_2CH{=}CHF$); 1,1,1,2,3,4,4,4-octafluoro-2-butene ($CF_3CF{=}CFCF_3$); 1,1,2,3,3,4,4,4-octafluoro-1-butene ($CF_3CF_2CF{=}CF_2$), 1,1,1,2,4,4,4-heptafluoro-2-butene ($CF_3CF{=}CHCF_3$); 1,2,3,3,4,4,4-heptafluoro-1-butene ($CHF{=}CFCF_2CF_3$); 1,1,1,2,3,4,4-heptafluoro-2-butene ($CHF_2CF{=}CFCF_3$), 1,3,3,3-tetrafluoro-2-(trifluoromethyl)-1-propene ($(CF_3)_2C{=}CHF$), 1,1,3,3,4,4,4-heptafluoro-1-butene ($CF_2{=}CHCF_2CF_3$), 1,1,2,3,4,4,4-heptafluoro-1-butene ($CF_2{=}CFCHFCF_3$), 1,1,2,3,3,4,4-heptafluoro-1-butene ($CF_2{=}CFCF_2CHF_2$), 2,3,3,4,4,4-hexafluoro-1-butene ($CF_3CF_2CF{=}CH_2$), 1,3,3,4,4,4-hexafluoro-1-butene ($CHF{=}CHCF_2CF_3$); 1,2,3,4,4,4-hexafluoro-1-butene ($CHF{=}CFCHFCF_3$); 1,2,3,3,4,4-hexafluoro-1-butene ($CHF{=}CFCF_2CHF_2$); 1,1,2,3,4,4-hexafluoro-2-butene ($CHF_2CF{=}CFCHF_2$), 1,1,1,2,3,4-hexafluoro-2-butene ($CH_2FCF{=}CFCF_3$), 1,1,1,2,4,4-hexafluoro-2-butene ($CHF_2CH{=}CFCF_3$), 1,1,1,3,4,4-hexafluoro-2-butene ($CF_3CH{=}CFCHF_2$); 1,1,2,3,3,4-hexafluoro-1-butene ($CF_2{=}CFCF_2CH_2F$), 1,1,2,3,4,4-hexafluoro-1-butene ($CF_2{=}CFCHFCHF_2$), 3,3,3-trifluoro-2-(trifluoromethyl)-1-propene ($CH_2{=}C(CF_3)_2$), 1,1,1,2,4-pentafluoro-2-butene ($CH_2FCH{=}CFCF_3$), 1,1,1,3,4-pentafluoro-2-butene ($CF_3CH{=}CFCH_2F$); 3,3,4,4,4-pentafluoro-1-butene ($CF_3CF_2CH{=}CH_2$), 1,1,1,4,4-pentafluoro-2-butene ($CHF_2CH{=}CHCF_3$), 1,1,1,2,3-pentafluoro-2-butene ($CH_3CF{=}CFCF_3$); 2,3,3,4,4-pentafluoro-1-butene ($CH_2{=}CFCF_2CHF_2$), 1,1,2,4,4-pentafluoro-2-butene ($CHF_2CF{=}CHCHF_2$), 1,1,2,3,3-pentafluoro-1-butene ($CH_3CF_2CF{=}CF_2$), 1,1,2,3,4-pentafluoro-2-butene ($CH_2FCF{=}CFCHF_2$), 1,1,3,3,3-pentafluoro-2-methyl-1-propene ($CF_2{=}C(CF_3)(CH_3)$); 2-(difluoromethyl)-3,3,3-trifluoro-1-propene ($CH_2{=}C(CHF_2)(CF_3)$); 2,3,4,4,4-pentafluoro-1-butene ($CH_2{=}CFCHFCF_3$), 1,2,4,4,4-pentafluoro-1-butene ($CHF{=}CFCH_2CF_3$); 1,3,4,4,4-pentafluoro-1-butene ($CHF{=}CHCHFCF_3$); 1,3,3,4,4-pentafluoro-1-butene ($CHF{=}CHCF_2CHF_2$); 1,2,3,4,4-pentafluoro-1-butene ($CHF{=}CFCHFCHF_2$); 3,3,4,4-tetrafluoro-1-butene ($CH_2{=}CHCF_2CHF_2$), 1,1-difluoro-2-(difluoromethyl)-1-propene ($CF_2{=}C(CHF_2)(CH_3)$); 1,3,3,3-tetrafluoro-2-methyl-1-propene ($CHF{=}C(CF_3)(CH_3)$); 3,3-difluoro-2-(difluoromethyl)-1-propene ($CH_2{=}C(CHF_2)_2$), 1,1,1,2-tetrafluoro-2-butene ($CF_3CF{=}CHCH_3$); 1,1,1,3-tetrafluoro-2-butene ($CH_3CF{=}CHCF_3$); 1,1,1,2,3,4,4,5,5,5-decafluoro-2-pentene ($CF_3CF{=}CFCF_2CF_3$); 1,1,2,3,3,4,4,5,5,5-decafluoro-1-pentene ($CF_2{=}CFCF_2CF_2CF_3$), 1,1,1,4,4,4-hexafluoro-2-(trifluoromethyl)-2-butene ($(CF_3)_2C{=}CHCF_3$), 1,1,1,2,4,4,5,5,5-nonafluoro-2-pentene ($CF_3CF{=}CHCF_2CF_3$); 1,1,1,3,4,4,5,5,5-nonafluoro-2-pentene ($CF_3CH{=}CFCF_2CF_3$); 1,2,3,3,4,4,5,5,5-nonafluoro-1-pentene ($CHF{=}CFCF_2CF_2CF_3$); 1,1,3,3,4,4,5,5,5-nonafluoro-1-pentene ($CF_2{=}CHCF_2CF_2CF_3$), 1,1,2,3,3,4,4,5,5-nonafluoro-1-pentene ($CF_2{=}CFCF_2CF_2CHF_2$), 1,1,2,3,4,4,5,5,5-nonafluoro-2-pentene ($CHF_2CF{=}CFCF_2CF_3$); 1,1,1,2,3,4,4,5,5-nonafluoro-2-pentene ($CF_3CF{=}CFCF_2CHF_2$); 1,1,1,2,3,4,5,5,5-nonafluoro-2-pentene ($CF_3CF{=}CFCHFCF_3$); 1,2,3,4,4,4-hexafluoro-3-(trifluoromethyl)-1-butene ($CHF{=}CFCF(CF_3)_2$), 1,1,2,4,4,4-hexafluoro-3-(trifluoromethyl)-1-butene ($CF_2{=}CFCH(CF_3)_2$); 1,1,1,4,4,4-hexafluoro-2-(trifluoromethyl)-2-butene ($CF_3CH{=}C(CF_3)_2$), 1,1,3,4,4,4-hexafluoro-3-(trifluoromethyl)-1-butene ($CF_2{=}CHCF(CF_3)_2$), 2,3,3,4,4,5,5,5-octafluoro-1-pentene ($CH_2{=}CFCF_2CF_2CF_3$), 1,2,3,3,4,4,5,5-octafluoro-1-pentene ($CHF{=}CFCF_2CF_2CHF_2$); 3,3,4,4,4-pentafluoro-2-(trifluoromethyl)-1-butene ($CH_2{=}C(CF_3)CF_2CF_3$), 1,1,4,4,4-pentafluoro-3-(trifluoromethyl)-1-butene ($CF_2{=}CHCH(CF_3)_2$), 1,3,4,4,4-pentafluoro-3-(trifluoromethyl)-1-butene ($CHF{=}CHCF(CF_3)_2$), 1,1,4,4,4-pentafluoro-2-(trifluoromethyl)-1-butene ($CF_2{=}C(CF_3)CH_2CF_3$), 3,4,4,4-tetrafluoro-3-(trifluoromethyl)-1-butene ($(CF_3)_2CFCH{=}CH_2$), 3,3,4,4,5,5,5-heptafluoro-1-pentene ($CF_3CF_2CF_2CH{=}CH_2$), 2,3,3,4,4,5,5-heptafluoro-1-pentene ($CH_2{=}CFCF_2CF_2CHF_2$), 1,1,3,3,5,5,5-heptafluoro-1-butene ($CF_2{=}CHCF_2CH_2CF_3$), 1,1,1,2,4,4,4-heptafluoro-3-methyl-2-butene ($CF_3CF{=}C(CF_3)(CH_3)$); 2,4,4,4-tetrafluoro-3-(trifluoromethyl)-1-butene ($CH_2{=}CFCH(CF_3)_2$), 1,4,4,4-tetrafluoro-3-(trifluoromethyl)-1-butene ($CHF{=}CHCH(CF_3)_2$), 1,1,1,4-tetrafluoro-2-(trifluoromethyl)-2-butene ($CH_2FCH{=}C(CF_3)_2$), 1,1,1,3-tetrafluoro-2-(trifluoromethyl)-2-butene ($CH_3CF{=}C(CF_3)_2$), 1,1,1-trifluoro-2-(trifluoromethyl)-2-butene ($(CF_3)_2C{=}CHCH_3$), 3,4,4,5,5,5-hexafluoro-2-pentene ($CF_3CF_2CF{=}CHCH_3$), 1,1,1,4,4,4-hexafluoro-2-methyl-2-butene ($CF_3C(CH_3){=}CHCF_3$), 3,3,4,5,5,5-hexafluoro-1-pentene ($CH_2{=}CHCF_2CHFCF_3$), 4,4,4-trifluoro-2-(trifluoromethyl)-1-butene ($CH_2{=}C(CF_3)CH_2CF_3$), 1,1,2,3,3,4,4,5,5,6,6,6-dodecafluoro-1-hexene ($CF_3(CF_2)_3CF{=}CF_2$), 1,1,1,2,2,3,4,5,5,6,6,6-dodecafluoro-3-hexene ($CF_3CF_2CF{=}CFCF_2CF_3$), 1,1,1,4,4,4-hexafluoro-2,3-bis(trifluoromethyl)-2-butene ($(CF_3)_2C{=}C(CF_3)_2$), 1,1,1,2,3,4,5,5,5-nonafluoro-4-(trifluoromethyl)-2-pentene ($(CF_3)_2CFCF{=}CFCF_3$), 1,1,1,4,4,5,5,5-octafluoro-2-(trifluoromethyl)-2-pentene ($(CF_3)_2C{=}CHC_2F_5$), 1,1,1,3,4,5,5,5-octafluoro-4-(trifluoromethyl)-2-pentene ($(CF_3)_2CFCF{=}CHCF_3$), 3,3,4,4,5,5,6,6,6-nonafluoro-1-hexene ($CF_3CF_2CF_2CF_2CH{=}CH_2$), 4,4,4-trifluoro-3,3-bis(trifluoromethyl)-1-butene ($CH_2{=}CHC(CF_3)_3$), 1,1,1,4,4,4-hexafluoro-3-methyl-2-(trifluoromethyl) butene ($(CF_3)_2C{=}C(CH_3)(CF_3)$); 2,3,3,5,5,5-hexafluoro-4-(trifluoromethyl)-1-pentene ($CH_2{=}CFCF_2CH(CF_3)_2$), 1,1,1,2,4,4,5,5,5-nonafluoro-3-methyl-2-pentene ($CF_3CF{=}C(CH_3)CF_2CF_3$), 1,1,1,5,5,5-hexafluoro-4-(trifluoromethyl)-2-pentene ($CF_3CH{=}CHCH(CF_3)_2$), 3,4,4,5,5,6,6,6-octafluoro-2-hexene ($CF_3CF_2CF_2CF{=}CHCH_3$); 3,3,4,4,5,5,6,6-octafluorol-hexene ($CH_2{=}CHCF_2CF_2CF_2CHF_2$), 1,1,1,4,4-pentafluoro-2-(trifluoromethyl)-2-pentene ($(CF_3)_2C{=}CHCF_2CH_3$), 4,4,5,5,5-pentafluoro-2-(trifluoromethyl)-1-pentene ($CH_2{=}C(CF_3)CH_2Cl_2F_5$), 3,3,4,4,5,5,5-heptafluoro-2-methyl-1-pentene ($CF_3CF_2CF_2C(CH_3){=}CH_2$), 4,4,5,5,6,6,6-heptafluoro-2-hexene ($CF_3CF_2CF_2CH{=}CHCH_3$); 4,4,5,5,6,6,6-heptafluoro-1-hexene ($CH_2{=}CHCH_2CF_2C_2F_5$), 1,1,1,2,2,3,4-heptafluoro-3-hexene ($CF_3CF_2CF{=}CFC_2H_5$), 4,5,5,5-tetrafluoro-4-(trifluoromethyl)-1-pentene ($CH_2{=}CHCH_2CF(CF_3)_2$), 1,1,1,2,5,5,5-heptafluoro-4-methyl-2-pentene ($CF_3CF{=}CHCH(CF_3)(CH_3)$); 1,1,1,3-tetrafluoro-2-(trifluoromethyl)-2-pentene ($(CF_3)_2C{=}CFC_2H_5$), 1,1,1,2,3,4,4,5,5,6,6,7,7,7-tetradecafluoro-2-heptene ($CF_3CF{=}CCF_2CF_2C_2F_5$), 1,1,1,2,2,3,4,5,5,6,6,7,7,7-tetradecafluoro-3-heptene ($CF_3CF_2CF{=}CFCF_2C_2F_5$), 1,1,1,3,4,4,5,5,6,6,7,7,7-tridecafluoro-2-heptene ($CF_3CH{=}CFCF_2CF_2C_2F_5$), 1,1,1,2,4,4,5,5,6,6,7,7,7-tridecafluoro-2-heptene ($CF_3CF{=}CHCF_2CF_2C_2F_5$), 1,1,1,2,2,4,5,5,6,6,7,7,7-tridecafluoro-3-heptene ($CF_3CF_2CH{=}CFCF_2C_2F_5$), 1,1,1,2,2,3,5,5,6,6,7,7,7-tridecafluoro-3-heptene ($CF_3CF_2CF{=}CHCF_2C_2F_5$), pentafluoroethyl trifluorovinyl ether ($CF_2{=}CFOCF_2CF_3$), and trifluoromethyl trifluorovinyl ether ($CF_2{=}CFOCF_3$).

In addition, sub-cooling has been found to enhance the performance and efficiency of systems which use cross-current/counter-current heat exchange, such as those which employ either a dual-row condenser or a dual-row evaporator.

Therefore, further in accordance with the method of the present invention, the present disclosure also provides that the condensing step may comprise:

(i) circulating the working fluid to a back row of the dual-row condenser, where the back row receives the working fluid at a first temperature; and (ii) circulating the working fluid to a front row of the dual-row condenser, where the front row receives the working fluid at a second temperature, where the second temperature is less than the first temperature, so that air which travels across the front row and the back row is preheated, whereby the temperature of the air is greater when it reaches the back row than when it reaches the front row.

Further in accordance with the method of the present invention, the present disclosure also provides that the evaporating step may comprise:

(i) passing the working fluid through an inlet of a dual-row evaporator having a first row and a second row, (ii) circulating the working fluid in a first row in a direction perpendicular to the flow of fluid through the inlet of the evaporator, and (iii) circulating the working fluid in a second row in a direction generally counter to the direction of the flow of the working fluid through the inlet.

Also in accordance with the present invention, there is provided a vapor compression heat transfer system for exchanging heat comprising an intermediate heat exchanger in combination with a dual-row condenser or a dual-row evaporator, or both.

BRIEF DESCRIPTION OF THE DRAWINGS

The present invention may be better understood with reference to the following figures, wherein.

DETAILED DESCRIPTION OF THE INVENTION

Figure 1A:
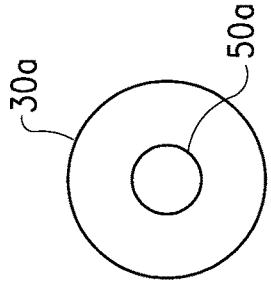
FIG. 1A is a cross-sectional view of one embodiment of an intermediate heat exchanger.
Figure 1:
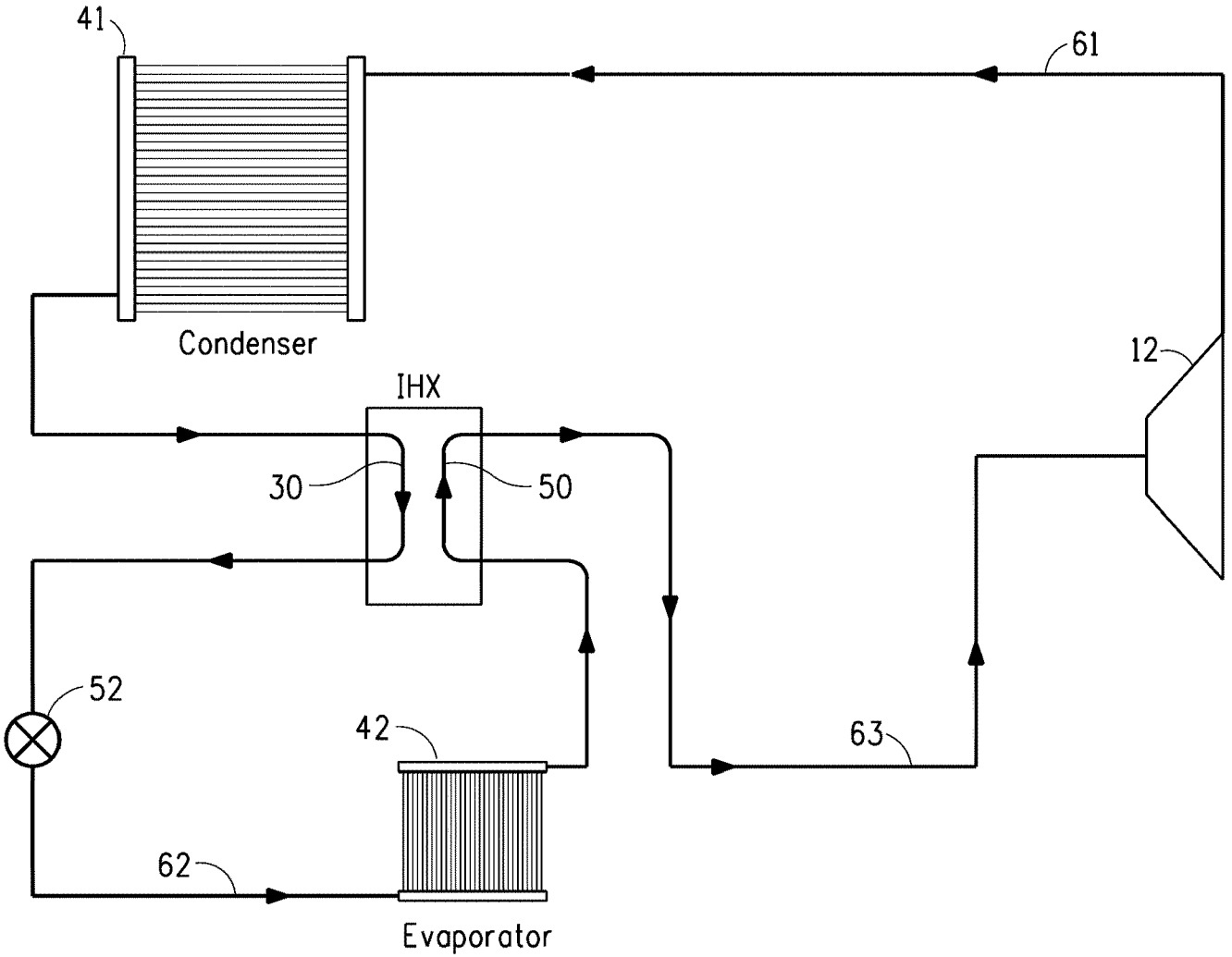
FIG. 1 is a schematic diagram of one embodiment of a vapor compression heat transfer system including an intermediate heat exchanger, used to practice the method of circulating a working fluid comprising a fluoroolefin through this system according to the present invention.

One embodiment of the present disclosure provides a method of circulating a working fluid comprising a fluoroolefin through a vapor compression heat transfer system. A vapor-compression heat transfer system is a closed loop system which re-uses working fluid in multiple steps producing a cooling effect in one step and a heating effect in a different step. Such a system generally includes an evaporator, a compressor, a condenser and an expansion device, and is known in the art. Reference will be made to FIG. 1 in describing this method.

With reference to FIG. 1, liquid working fluid from a condenser 41 flows through a line to an intermediate heat exchanger, or simply IHX. The intermediate heat exchanger includes a first tube 30, which contains a relatively hot liquid working fluid, and a second tube 50, which contains a relatively colder gaseous working fluid. The first tube of the IHX is connected to the outlet line of the condenser. The liquid working fluid then flows through an expansion device 52 and through a line 62 to an evaporator 42, which is located in the vicinity of a body to cooled. In the evaporator, the working fluid is evaporated, and the vaporization of the working fluid provides cooling. The expansion device 52 may be an expansion valve, a capillary tube, an orifice tube or any other device where the working fluid may undergo an abrupt reduction in pressure. The evaporator has an outlet, through which the cold gaseous working fluid flows to the second tube 50 of the IHX, wherein the cold gaseous working fluid comes in thermal contact with the hot liquid working fluid in the first tube 30 of the IHX, and thus the cold gaseous working fluid is warmed somewhat. The gaseous working fluid flows from the second tube of the IHX through a line 63 to the inlet of a compressor 12. The gas is compressed in the compressor, and the compressed gaseous working fluid is discharged from the compressor and flows to the condenser 41 through a line 61 wherein the working fluid is condensed, thus giving off heat, and the cycle then repeats.

In an intermediate heat exchanger, the first tube containing the relatively hotter liquid working fluid and the second tube containing the relatively colder gaseous working fluid are in thermal contact, thus allowing transfer of heat from the hot liquid to the cold gas. The means by which the two tubes are in thermal contact may vary. In one embodiment, the first tube has a larger diameter than the second tube, and the second tube is disposed concentrically in the first tube, and a hot liquid in the first tube surrounds a cold gas in the second tube. This embodiment is shown in FIG. 1A, where the first tube (30*a*) surrounds the second tube (50*a*).

Also, in one embodiment, the working fluid in the second tube of the internal heat exchanger may flow in a counter-current direction to the direction of flow of the working fluid in the first tube, thereby cooling the working fluid in the first tube and heating the working fluid in the second tube.

Cross-current/counter-current heat exchange may be provided in the system of FIG. 1 by a dual-row condenser or a dual-row evaporator, although it should be noted that this system is not limited to such a dual-row condensers or evaporators. Such condensers and evaporators are described in detail in U.S. Provisional Patent Application No. 60/875,982, filed Dec. 19, 2006 (now International Application PCT/US07/25675, filed Dec. 17, 2007), and may be designed particularly for working fluids that comprise non-azeotropic or near-azeotropic compositions.

Therefore, in accordance with the present invention, there is provided a vapor compression heat transfer system which comprises either a dual-row condenser, or a dual-row evaporator, or both. Such a system is the same as that described above with respect to FIG. 1, except for the description of the dual-row condenser or the dual-row evaporator.

Figure 2:
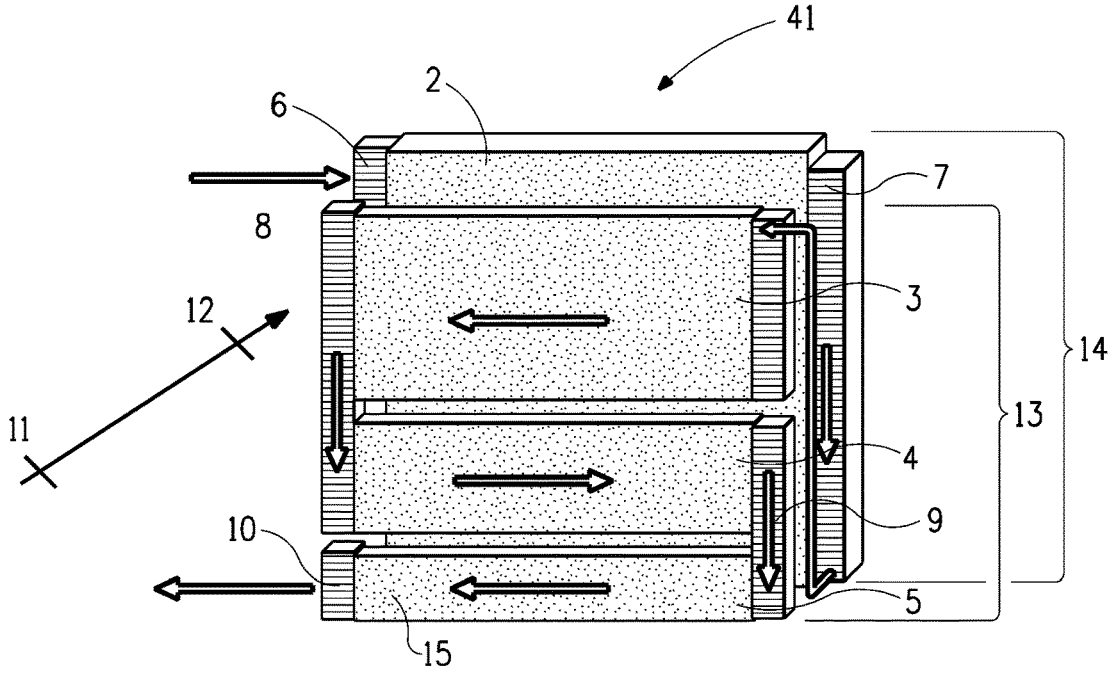
FIG. 2 is a perspective view of a dual-row condenser which can be used with the vapor compression heat transfer system of FIG. 1.

Reference will be made to FIG. 2 to describe such a system which includes a dual-row condenser. A dual-row condenser is shown at 41 in FIG. 2. In this dual-row cross-current/counter-current design, a hot working fluid enters the condenser through a first, or back row 14, passes through the first row, and exits the condenser through a second, or front row 13. The working fluid enters first row 14 via a collector 6 inside a first pass 2 of the first row. In the first, or back row, the working fluid is cooled in a counter current manner by air, which has been heated by the second, or front row 13 of this dual-row condenser. The working fluid goes from first pass 2 of the first row 14, to a pass 3 of the second, or front row 13 by a connection 7. The working fluid then flows from pass 3 to a pass 4 in second row 13 through a connection 8, and then flows from pass 4 to a pass 5 through a connection 9. Then the sub-cooled working fluid exits the condenser by a connection 10. Air is circulated in a counter-current manner relative to the working fluid flow, as indicated by the arrow having points 11 and 12 of FIG. 2. The design shown in FIG. 2 is generic and can be used for any air-to-refrigerant condenser in stationary applications as well as in mobile applications.

Figure 3:
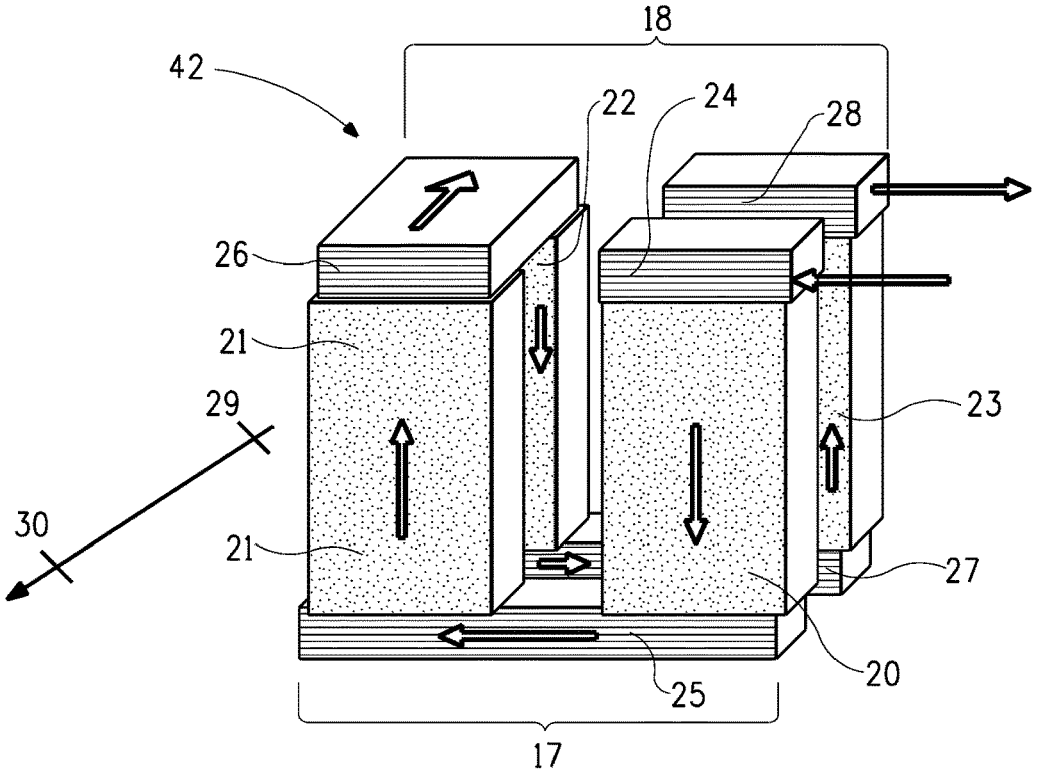
FIG. 3 is a perspective view of a dual-row evaporator used which can be used with the vapor compression heat transfer system of FIG. 1.

Reference will be made to FIG. 3 in describing a vapor compression heat transfer system comprising a dual-row evaporator. A dual-row evaporator is shown at 42 in FIG. 3. In this dual-row cross-current/counter-current design, working fluid enters the evaporator through a first, or front row 17, passes through the first row, and exits the condenser through a second, or back row 18. In particular, the working fluid enters the evaporator 19 at the lowest temperature through a collector 24 as shown in FIG. 3. Then the working fluid flows downwards through a tank 20 to a tank 21 through a collector 25, then from tank 21 to a tank 22 in the back row through a collector 26. The working fluid then flows from tank 22 to a tank 23 through a collector 27, and finally exits the evaporator through a collector 28. Air is circulated in a cross-countercurrent arrangement as indicated by the arrow having points 29 and 30, of FIG. 3.

In the embodiments as shown in FIGS. 1, 1A, 2 and 3, the connecting lines between the components of the vapor compression heat transfer system, through which the working fluid may flow, may be constructed of any typical conduit material known for such purpose. In one embodiment, metal piping or metal tubing (such as aluminum or copper or copper alloy tubing) may be used to connect the components of the heat transfer system. In another embodiment, hoses, constructed of various materials, such as polymers or elastomers, or combinations of such materials with reinforcing materials such as metal mesh etc., may be used in the system. One example of a hose design for heat transfer systems, in particular for automobile air conditioning systems, is provided in U.S. Provisional Patent Application No. 60/841,713, filed Sep. 1, 2006 (now International Application PCT/US07/019205 filed Aug. 31, 2007 and published as WO2008-027255A1 on Mar. 6, 2008). For the tubes of the IHX, metal piping or tubing provides more efficient transfer of heat from the hot liquid working fluid to the cold gaseous working fluid.

Various types of compressors may be used in the vapor compression heat transfer system of the embodiments of the present invention, including reciprocating, rotary, jet, centrifugal, scroll, screw or axial-flow, depending on the mechanical means to compress the fluid, or as positive-displacement (e.g., reciprocating, scroll or screw) or dynamic (e.g., centrifugal or jet).

In certain embodiments the heat transfer systems as disclosed herein may employ fin and tube heat exchangers, microchannel heat exchangers and vertical or horizontal single pass tube or plate type heat exchangers, among others for both the evaporator and condenser.

The closed loop vapor compression heat transfer system as described herein may be used in stationary refrigeration, air-conditioning, and heat pumps or mobile air-conditioning and refrigeration systems. Stationary air-conditioning and heat pump applications include window, ductless, ducted, packaged terminal, chillers and light commercial and commercial air-conditioning systems, including packaged rooftop. Refrigeration applications include domestic or home refrigerators and freezers, ice machines, self-contained coolers and freezers, walk-in coolers and freezers and supermarket systems, and transport refrigeration systems.

Mobile refrigeration or mobile air-conditioning systems refer to any refrigeration or air-conditioning system incorporated into a transportation unit for the road, rail, sea or air. In addition, apparatus, which are meant to provide refrigeration or air-conditioning for a system independent of any moving carrier, known as "intermodal" systems, are included in the present invention. Such intermodal systems include "containers" (combined sea/land transport) as well as "swap bodies" (combined road and rail transport). The present invention is particularly useful for road transport refrigerating or air-conditioning apparatus, such as automobile air-conditioning apparatus or refrigerated road transport equipment.

The working fluid utilized in the vapor compression heat transfer system comprises at least one fluoroolefin. By fluoroolefin is meant any compound containing carbon, fluorine and optionally, hydrogen or oxygen that also contains at least one double bond. These fluoroolefins may be linear, branched or cyclic.

Fluoroolefins have a variety of utilities in working fluids, which include use as foaming agents, blowing agents, fire extinguishing agents, heat transfer mediums (such as heat transfer fluids and refrigerants for use in refrigeration systems, refrigerators, air-conditioning systems, heat pumps, chillers, and the like), to name a few.

In some embodiments, heat transfer compositions may comprise fluoroolefins comprising at least one compound with 2 to 12 carbon atoms, in another embodiment the fluoroolefins comprise compounds with 3 to 10 carbon atoms, and in yet another embodiment the fluoroolefins comprise compounds with 3 to 7 carbon atoms. Representative fluoroolefins include but are not limited to all compounds as listed in Table 1, Table 2, and Table 3.

In one embodiment, the present methods use working fluids comprising fluoroolefins having the formula E- or Z—$R^1CH{=}CHR^2$ (Formula I), wherein $R^1$ and $R^2$ are, independently, $C_1$ to $C_6$ perfluoroalkyl groups. Examples of $R^1$ and $R^2$ groups include, but are not limited to, $CF_3$, $C_2F_5$, $CF_2CF_2CF_3$, $CF(CF_3)_2$, $CF_2CF_2CF_2CF_3$, $CF(CF_3)CF_2CF_3$, $CF_2CF(CF_3)_2$, $C(CF_3)_3$, $CF_2CF_2CF_2CF_2CF_3$, $CF_2CF_2CF(CF_3)_2$, $C(CF_3)_2C_2F_5$, $CF_2CF_2CF_2CF_2CF_2CF_3$, $CF(CF_3)CF_2CF_2C_2F_5$, and $C(CF_3)_2CF_2C_2F_5$. In one embodiment the fluoroolefins of Formula I, have at least about 4 carbon atoms in the molecule. In another embodiment, the fluoroolefins of Formula I have at least about 5 carbon atoms in the molecule. Exemplary, non-limiting Formula I compounds are presented in Table 1.

TABLE 1

| Code | Structure | Chemical Name |
|---|---|---|
| F11E | $CF_3CH{=}CHCF_3$ | 1,1,1,4,4,4-hexafluorobut-2-ene |
| F12E | $CF_3CH{=}CHC_2F_5$ | 1,1,1,4,4,5,5,5-octafluoropent-2-ene |
| F13E | $CF_3CH{=}CHCF_2C_2F_5$ | 1,1,1,4,4,5,5,6,6,6-decafluorohex-2-ene |
| F13iE | $CF_3CH{=}CHCF(CF_3)_2$ | 1,1,1,4,5,5,5-heptafluoro-4-(trifluoromethyl)pent-2-ene |
| F22E | $C_2F_5CH{=}CHC_2F_5$ | 1,1,1,2,2,5,5,6,6,6-decafluorohex-3-ene |
| F14E | $CF_3CH{=}CH(CF_2)_3CF_3$ | 1,1,1,4,4,5,5,6,6,7,7,7-dodecafluorohex-3-ene |
| F14iE | $CF_3CH{=}CHCF_2CF(CF_3)_2$ | 1,1,1,4,4,5,6,6,6-nonafluoro-5-(trifluoromethyl)hex-2-ene |
| F14sE | $CF_3CH{=}CHCF(CF_3)C_2F_5$ | 1,1,1,4,5,5,6,6,6-nonfluoro-4-(trifluoromethyl)hex-2-ene |
| F14tE | $CF_3CH{=}CHC(CF_3)_3$ | 1,1,1,5,5,5-hexafluoro-4,4-bis(trifluoromethyl)pent-2-ene |
| F23E | $C_2F_5CH{=}CHCF_2C_2F_5$ | 1,1,1,2,2,5,5,6,6,7,7,7-dodecafluorohept-3-ene |
| F23iE | $C_2F_5CH{=}CHCF(CF_3)_2$ | 1,1,1,2,2,5,6,6,6-nonafluoro-5-(trifluoromethyl)hex-3-ene |
| F15E | $CF_3CH{=}CH(CF_2)_4CF_3$ | 1,1,1,4,4,5,5,6,6,7,7,8,8,8-tetradecafluorooct-2-ene |
| F15iE | $CF_3CH{=}CH{-}CF_2CF_2CF(CF_3)_2$ | 1,1,1,4,4,5,5,6,7,7,7-undecafluoro-6-(trifluoromethyl)hept-2-ene |
| F15tE | $CF_3CH{=}CH{-}C(CF_3)_2C_2F_5$ | 1,1,1,5,5,6,6,6-octafluoro-4,4-bis(trifluoromethyl)hex-2-ene |
| F24E | $C_2F_5CH{=}CH(CF_2)_3CF_3$ | 1,1,1,2,2,5,5,6,6,7,7,8,8,8-tetradecafluorooct-3-ene |
| F24iE | $C_2F_5CH{=}CHCF_2CF(CF_3)_2$ | 1,1,1,2,2,5,5,6,7,7,7-undecafluoro-6-(trifluoromethyl)hept-2-ene |
| F24sE | $C_2F_5CH{=}CHCF(CF_3)C_2F_5$ | 1,1,1,2,2,5,6,6,7,7,7-undecafluoro-5-(trifluoromethyl)hept-3-ene |
| F24tE | $C_2F_5CH{=}CHC(CF_3)_3$ | 1,1,1,2,2,6,6,6-octafluoro-5,5-bis(trifluoromethyl)hex-3-ene |
| F33E | $C_2F_5CF_2CH{=}CHCF_2C_2F_5$ | 1,1,1,2,2,3,3,6,6,7,7,8,8,8-tetradecafluorooct-4-ene |
| F3i3iE | $(CF_3)_2CFCH{=}CHCF(CF_3)_2$ | 1,1,1,2,5,6,6,6-octafluoro-2,5-bis(trifluoromethyl)hex-3-ene |
| F33iE | $C_2F_5CF_2CH{=}CHCF(CF_3)_2$ | 1,1,1,2,5,5,6,6,7,7,7-undecafluoro-2-(trifluoromethyl)hept-3-ene |
| F16E | $CF_3CH{=}CH(CF_2)_5CF_3$ | 1,1,1,4,4,5,5,6,6,7,7,8,8,,9,9,9-hexadecafluoronon-2-ene |
| F16sE | $CF_3CH{=}CHCF(CF_3)(CF_2)_2C_2F_5$ | 1,1,1,4,5,5,6,6,7,7,8,8,8-tridecafluoro-4-(trifluoromethyl)hept-2-ene |
| F16tE | $CF_3CH{=}CHC(CF_3)_2CF_2C_2F_5$ | 1,1,1,6,6,6-octafluoro-4,4-bis(trifluoromethyl)hept-2-ene |
| F25E | $C_2F_5CH{=}CH(CF_2)_4CF_3$ | 1,1,1,2,2,5,5,6,6,7,7,8,8,9,9,9-hexadecafluoronon-3-ene |
| F25iE | $C_2F_5CH{=}CH{-}CF_2CF_2CF(CF_3)_2$ | 1,1,1,2,2,5,5,6,6,7,8,8,8-tridecafluoro-7-(trifluoromethyl)oct-3-ene |
| F25tE | $C_2F_5CH{=}CH{-}C(CF_3)_2C_2F_5$ | 1,1,1,2,2,6,6,7,7,7-decafluoro-5,5-bis(trifluoromethyl)hept-3-ene |
| F34E | $C_2F_5CF_2CH{=}CH{-}(CF_2)_3CF_3$ | 1,1,1,2,2,3,3,6,6,7,7,8,8,9,9,9-hexadecafluoronon-4-ene |
| F34iE | $C_2F_5CF_2CH{=}CH{-}CF_2CF(CF_3)_2$ | 1,1,1,2,2,3,3,6,6,7,8,8,8-tridecafluoro-7-(trifluoromethyl)oct-4-ene |
| F34sE | $C_2F_5CF_2CH{=}CHCF(CF_3)C_2F_5$ | 1,1,1,2,2,3,3,6,7,7,8,8,8-tridecafluoro-6-(trifluoromethyl)oct-4-ene |
| F34tE | $C_2F_5CF_2CH{=}CHC(CF_3)_3$ | 1,1,1,5,5,6,6,7,7,7-decafluoro-2,2-bis(trifluoromethyl)hept-3-ene |
| F3i4E | $(CF_3)_2CFCH{=}CH(CF_2)_3CF_3$ | 1,1,1,2,5,5,6,6,7,7,8,8,8-tridecafluoro-2(trifluoromethyl)oct-3-ene |
| F3i4iE | $(CF_3)_2CFCH{=}CHCF_2CF(CF_3)_2$ | 1,1,1,2,5,5,6,7,7,7-decafluoro-2,6-bis(trifluoromethyl)hept-3-ene |
| F3i4sE | $(CF_3)_2CFCH{=}CHCF(CF_3)C_2F_5$ | 1,1,1,2,5,6,6,7,7,7-decafluoro-2,5-bis(trifluoromethyl)hept-3-ene |
| F3i4tE | $(CF_3)_2CFCH{=}CHC(CF_3)_3$ | 1,1,1,2,6,6,6-heptafluoro-2,5,5-tris(trifluoromethyl)hex-3-ene |
| F26E | $C_2F_5CH{=}CH(CF_2)_5CF_3$ | 1,1,1,2,2,5,5,6,6,7,7,8,8,9,9,10,10,10-octadecafluorodec-3-ene |
| F26sE | $C_2F_5CH{=}CHCF(CF_3)(CF_2)_2C_2F_5$ | 1,1,1,2,2,5,6,6,7,7,8,8,9,9,9-pentadecafluoro-5-(trifluoromethyl)non-3-ene |
| F26tE | $C_2F_5CH{=}CHC(CF_3)_2{-}CF_2C_2F_5$ | 1,1,1,2,2,6,6,7,7,8,8,8-dodecafluoro-5,5-bis(trifluoromethyl)oct-3-ene |
| F35E | $C2F_5CF_2CH{=}CH{-}(CF_2)_4CF_3$ | 1,1,1,2,2,3,3,6,6,7,7,8,8,9,9,10,10,10-octadecafluorodec-4-ene |
| F35iE | $C_2F_5CF_2CH{=}CHCF_2CF_2{-}CF(CF_3)_2$ | 1,1,1,2,2,3,3,6,6,7,7,8,9,9,9-pentadecafluoro-8-(trifluoromethyl)non-4-ene |
| F35tE | $C_2F_5CF_2CH{=}CH{-}C(CF_3)_2C_2F_5$ | 1,1,1,2,2,3,3,7,7,8,8,8-dodecafluoro-6,6-bis(trifluoromethyl)oct-4-ene |
| F3i5E | $(CF_3)_2CFCH{=}CH{-}(CF_2)_4CF_3$ | 1,1,1,2,5,5,6,6,7,7,8,8,9,9,9-pentadecafluoro-2-(trifluoromethyl)non-3-ene |
| F3i5iE | $(CF_3)_2CFCH{=}CHCF_2CF_2{-}CF(CF_3)_2$ | 1,1,1,2,5,5,6,6,7,8,8,8-dodecafluoro-2,7-bis(trifluoromethyl)oct-3-ene |
| F3i5tE | $(CF_3)_2CFCH{=}CHC(CF3)_2C_2F_5$ | 1,1,1,2,6,6,7,7,7-nonafluoro-2,5,5-tris(trifluoromethyl)hept-3-ene |
| F44E | $CF3(CF_2)_3CH{=}CH(CF_2)_3CF_3$ | 1,1,1,2,2,3,3,4,4,7,7,8,8,9,9,10,10,10-octadecafluorodec-5-ene |
| F44iE | $CF_3(CF_2)_3CH{=}CH{-}CF_2CF(CF_3)_2$ | 1,1,1,2,3,3,6,6,7,7,8,8,9,9,9-pentadecafluoro-2-(trifluoromethyl)non-4-ene |
| F44sE | $CF_3(CF_2)_3CH{=}CHCF(CF_3)C_2F_5$ | 1,1,1,2,2,3,6,6,7,7,8,8,9,9,9-pentadecafluoro-3-(trifluoromethyl)non-4-ene |
| F44tE | $CF_3(CF_2)_3CH{=}CHC(CF_3)_3$ | 1,1,1,5,5,6,6,7,7,8,8,8-dodecafluoro-2,2,-bis(trifluoromethyl)oct-3-ene |
| F4i4iE | $(CF_3)_2CFCF_2CH{=}CHCF_2CF{-}(CF_3)_2$ | 1,1,1,2,3,3,6,6,7,8,8,8-dodecafluoro-2,7-bis(trifluoromethyl)oct-4-ene |
| F4i4sE | $(CF_3)_2CFCF_2CH{=}CHCF(CF_3){-}C_2F_5$ | 1,1,1,2,3,3,6,7,7,8,8,8-dodecafluoro-2,6-bis(trifluoromethyl)oct-4-ene |
| F4i4tE | $(CF_3)_2CFCF_2CH{=}CHC(CF_3)_3$ | 1,1,1,5,5,6,7,7,7-nonafluoro-2,2,6-tris(trifluoromethyl)hept-3-ene |
| F4s4sE | $C_2F_5CF(CF_3)CH{=}CH{-}CF(CF_3)C_2F_5$ | 1,1,1,2,2,3,6,7,7,8,8,8-dodecafluoro-3,6-bis(trifluoromethyl)oct-4-ene |
| F4s4tE | $C_2F_5CF(CF_3)CH{=}CH{-}C(CF_3)_3$ | 1,1,1,5,6,6,7,7,7-nonafluoro-2,2,5-tris(trifluoromethyl)hept-3-ene |
| F4t4tE | $(CF_3)_3CCH{=}CH{-}C(CF_3)_3$ | 1,1,1,6,6,6-hexafluoro-2,2,5,5-tetrakis(trifluoromethyl)hex-3-ene |

Compounds of Formula I may be prepared by contacting a perfluoroalkyl iodide of the formula $R^1I$ with a perfluoroalkyltrihydroolefin of the formula $R^2CH{=}CH_2$ to form a trihydroiodoperfluoroalkane of the formula $R^1CH_2CHIR^2$. This trihydroiodoperfluoroalkane can then be dehydroiodinated to form $R^1CH{=}CHR^2$. Alternatively, the olefin $R^1CH{=}CHR^2$ may be prepared by dehydroiodination of a trihydroiodoperfluoroalkane of the formula $R^1CHICH_2R^2$ formed in turn by reacting a perfluoroalkyl iodide of the formula $R^2I$ with a perfluoroalkyltrihydroolefin of the formula $R^1CH{=}CH_2$.

Said contacting of a perfluoroalkyl iodide with a perfluoroalkyltrihydroolefin may take place in batch mode by combining the reactants in a suitable reaction vessel capable of operating under the autogenous pressure of the reactants and products at reaction temperature. Suitable reaction vessels include fabricated from stainless steels, in particular of the austenitic type, and the well-known high nickel alloys such as Monel® nickel-copper alloys, Hastelloy® nickel-based alloys and Inconel® nickel-chromium alloys.

Alternatively, the reaction may take be conducted in semi-batch mode in which the perfluoroalkyltrihydroolefin reactant is added to the perfluoroalkyl iodide reactant by means of a suitable addition apparatus such as a pump at the reaction temperature.

The ratio of perfluoroalkyl iodide to perfluoroalkyltrihydroolefin should be between about 1:1 to about 4:1, preferably from about 1.5:1 to 2.5:1. Ratios less than 1.5:1 tend to result in large amounts of the 2:1 adduct as reported by Jeanneaux, et. al. in *Journal of Fluorine Chemistry*, Vol. 4, pages 261-270 (1974).

Preferred temperatures for contacting of said perfluoroalkyl iodide with said perfluoroalkyltrihydroolefin are preferably within the range of about 150° C. to 300° C., preferably from about 170° C. to about 250° C., and most preferably from about 180° C. to about 230° C.

Suitable contact times for the reaction of the perfluoroalkyl iodide with the perfluoroalkyltrihydroolefin are from about 0.5 hour to 18 hours, preferably from about 4 to about 12 hours.

The trihydroiodoperfluoroalkane prepared by reaction of the perfluoroalkyl iodide with the perfluoroalkyltrihydroolefin may be used directly in the dehydroiodination step or may preferably be recovered and purified by distillation prior to the dehydroiodination step.

The dehydroiodination step is carried out by contacting the trihydroiodoperfluoroalkane with a basic substance. Suitable basic substances include alkali metal hydroxides (e.g., sodium hydroxide or potassium hydroxide), alkali metal oxide (for example, sodium oxide), alkaline earth metal hydroxides (e.g., calcium hydroxide), alkaline earth metal oxides (e.g., calcium oxide), alkali metal alkoxides (e.g., sodium methoxide or sodium ethoxide), aqueous ammonia, sodium amide, or mixtures of basic substances such as soda lime. Preferred basic substances are sodium hydroxide and potassium hydroxide.

Said contacting of the trihydroiodoperfluoroalkane with a basic substance may take place in the liquid phase preferably in the presence of a solvent capable of dissolving at least a portion of both reactants. Solvents suitable for the dehydroiodination step include one or more polar organic solvents such as alcohols (e.g., methanol, ethanol, n-propanol, isopropanol, n-butanol, isobutanol, and tertiary butanol), nitriles (e.g., acetonitrile, propionitrile, butyronitrile, benzonitrile, or adiponitrile), dimethyl sulfoxide, N,N-dimethylformamide, N,N-dimethylacetamide, or sulfolane. The choice of solvent may depend on the boiling point product and the ease of separation of traces of the solvent from the product during purification. Typically, ethanol or isopropanol are good solvents for the reaction.

Typically, the dehydroiodination reaction may be carried out by addition of one of the reactants (either the basic substance or the trihydroiodoperfluoroalkane) to the other reactant in a suitable reaction vessel. Said reaction may be fabricated from glass, ceramic, or metal and is preferably agitated with an impeller or stirring mechanism.

Temperatures suitable for the dehydroiodination reaction are from about 10° C. to about 100° C., preferably from about 20° C. to about 70° C. The dehydroiodination reaction may be carried out at ambient pressure or at reduced or elevated pressure. Of note are dehydroiodination reactions in which the compound of Formula I is distilled out of the reaction vessel as it is formed.

Alternatively, the dehydroiodination reaction may be conducted by contacting an aqueous solution of said basic substance with a solution of the trihydroiodoperfluoroalkane in one or more organic solvents of lower polarity such as an alkane (e.g., hexane, heptane, or octane), aromatic hydrocarbon (e.g., toluene), halogenated hydrocarbon (e.g., methylene chloride, chloroform, carbon tetrachloride, or perchloroethylene), or ether (e.g., diethyl ether, methyl tert-butyl ether, tetrahydrofuran, 2-methyl tetrahydrofuran, dioxane, dimethoxyethane, diglyme, or tetraglyme) in the presence of a phase transfer catalyst. Suitable phase transfer catalysts include quaternary ammonium halides (e.g., tetrabutylammonium bromide, tetrabutylammonium hydrosulfate, triethylbenzylammonium chloride, dodecyltrimethylammonium chloride, and tricaprylylmethylammonium chloride), quaternary phosphonium halides (e.g., triphenylmethylphosphonium bromide and tetraphenylphosphonium chloride), or cyclic polyether compounds known in the art as crown ethers (e.g., 18-crown-6 and 15-crown-5).

Alternatively, the dehydroiodination reaction may be conducted in the absence of solvent by adding the trihydroiodoperfluoroalkane to a solid or liquid basic substance.

Suitable reaction times for the dehydroiodination reactions are from about 15 minutes to about six hours or more depending on the solubility of the reactants. Typically the dehydroiodination reaction is rapid and requires about 30 minutes to about three hours for completion.

The compound of formula I may be recovered from the dehydroiodination reaction mixture by phase separation after addition of water, by distillation, or by a combination thereof.

In another embodiment of the present invention, fluoroolefins comprise cyclic fluoroolefins (cyclo-[$CX{=}CY(CZW)_n$-] (Formula II), wherein X, Y, Z, and W are independently selected from H and F, and n is an integer from 2 to 5). In one embodiment the fluoroolefins of Formula II, have at least about 3 carbon atoms in the molecule. In another embodiment, the fluoroolefins of Formula II have at least about 4 carbon atoms in the molecule. In yet another embodiment, the fluoroolefins of Formula II have at least about 5 carbon atoms in the molecule. Representative cyclic fluoroolefins of Formula II are listed in Table 2.

TABLE 2

| Cyclic fluoroolefins | Structure | Chemical name |
|---|---|---|
| FC-C1316cc | cyclo-$CF_2CF_2CF{=}CF$— | 1,2,3,3,4,4-hexafluorocyclobutene |
| HFC-C1334cc | cyclo-$CF_2CF_2CH{=}CH$— | 3,3,4,4-tetrafluorocyclobutene |
| HFC-C1436 | cyclo-$CF_2CF_2CF_2CH{=}CH$— | 3,3,4,4,5,5,-hexafluorocyclopentene |
| FC-C1418y | cyclo-$CF_2CF{=}CFCF_2CF_2$— | 1,2,3,3,4,4,5,5-octafluorocyclopentene |
| FC-C151-10y | cyclo-$CF_2CF{=}CFCF_2CF_2CF_2$— | 1,2,3,3,4,4,5,5,6,6-decafluorocyclohexene |

The compositions of the present invention may comprise a single compound of Formula I or formula II, for example, one of the compounds in Table 1 or Table 2 or may comprise a combination of compounds of Formula I or formula II.

In another embodiment, fluoroolefins may comprise those compounds listed in Table 3.

TABLE 3

| Name | Structure | Chemical name |
|---|---|---|
| HFC-1225ye | $CF_3CF{=}CHF$ | 1,2,3,3,3-pentafluoro-1-propene |
| HFC-1225zc | $CF_3CH{=}CF_2$ | 1,1,3,3,3-pentafluoro-1-propene |
| HFC-1225yc | $CHF_2CF{=}CF_2$ | 1,1,2,3,3-pentafluoro-1-propene |
| HFC-1234ye | $CHF_2CF{=}CHF$ | 1,2,3,3-tetrafluoro-1-propene |
| HFC-1234yf | $CF_3CF{=}CH_2$ | 2,3,3,3-tetrafluoro-1-propene |
| HFC-1234ze | $CF_3CH{=}CHF$ | 1,3,3,3-tetrafluoro-1-propene |
| HFC-1234yc | $CH_2FCF{=}CF_2$ | 1,1,2,3-tetrafluoro-1-propene |
| HFC-1234zc | $CHF_2CH{=}CF_2$ | 1,1,3,3-tetrafluoro-1-propene |
| HFC-1243yf | $CHF_2CF{=}CH_2$ | 2,3,3-trifluoro-1-propene |
| HFC-1243zf | $CF_3CH{=}CH_2$ | 3,3,3-trifluoro-1-propene |
| HFC-1243yc | $CH_3CF{=}CF_2$ | 1,1,2-trifluoro-1-propene |
| HFC-1243zc | $CH_2FCH{=}CF_2$ | 1,1,3-trifluoro-1-propene |
| HFC-1243ye | $CH_2FCF{=}CHF$ | 1,2,3-trifluoro-1-propene |
| HFC-1243ze | $CHF_2CH{=}CHF$ | 1,3,3-trifluoro-1-propene |
| FC-1318my | $CF_3CF{=}CFCF_3$ | 1,1,1,2,3,4,4,4-octafluoro-2-butene |
| FC-1318cy | $CF_3CF_2CF{=}CF_2$ | 1,1,2,3,3,4,4,4-octafluoro-1-butene |
| HFC-1327my | $CF_3CF{=}CHCF_3$ | 1,1,1,2,4,4,4-heptafluoro-2-butene |
| HFC-1327ye | $CHF{=}CFCF_2CF_3$ | 1,2,3,3,4,4,4-heptafluoro-1-butene |
| HFC-1327py | $CHF_2CF{=}CFCF_3$ | 1,1,1,2,3,4,4-heptafluoro-2-butene |
| HFC-1327et | $(CF_3)_2C{=}CHF$ | 1,3,3,3-tetrafluoro-2-(trifluoromethyl)-1-propene |
| HFC-1327cz | $CF_2{=}CHCF_2CF_3$ | 1,1,3,3,4,4,4-heptafluoro-1-butene |
| HFC-1327cye | $CF_2{=}CFCHFCF_3$ | 1,1,2,3,4,4,4-heptafluoro-1-butene |
| HFC-1327cyc | $CF_2{=}CFCF_2CHF_2$ | 1,1,2,3,3,4,4-heptafluoro-1-butene |
| HFC-1336yf | $CF_3CF_2CF{=}CH_2$ | 2,3,3,4,4,4-hexafluoro-1-butene |
| HFC-1336ze | $CHF{=}CHCF_2CF_3$ | 1,3,3,4,4,4-hexafluoro-1-butene |
| HFC-1336eye | $CHF{=}CFCHFCF_3$ | 1,2,3,4,4,4-hexafluoro-1-butene |
| HFC-1336eyc | $CHF{=}CFCF_2CHF_2$ | 1,2,3,3,4,4-hexafluoro-1-butene |
| HFC-1336pyy | $CHF_2CF{=}CFCHF_2$ | 1,1,2,3,4,4-hexafluoro-2-butene |
| HFC-1336qy | $CH_2FCF{=}CFCF_3$ | 1,1,1,2,3,4-hexafluoro-2-butene |
| HFC-1336pz | $CHF_2CH{=}CFCF_3$ | 1,1,1,2,4,4-hexafluoro-2-butene |
| HFC-1336mzy | $CF_3CH{=}CFCHF_2$ | 1,1,1,3,4,4-hexafluoro-2-butene |
| HFC-1336qc | $CF_2{=}CFCF_2CH_2F$ | 1,1,2,3,3,4-hexafluoro-1-butene |
| HFC-1336pe | $CF_2{=}CFCHFCHF_2$ | 1,1,2,3,4,4-hexafluoro-1-butene |
| HFC-1336ft | $CH_2{=}C(CF_3)_2$ | 3,3,3-trifluoro-2-(trifluoromethyl)-1-propene |
| HFC-1345qz | $CH_2FCH{=}CFCF_3$ | 1,1,1,2,4-pentafluoro-2-butene |
| HFC-1345mzy | $CF_3CH{=}CFCH_2F$ | 1,1,1,3,4-pentafluoro-2-butene |
| HFC-1345fz | $CF_3CF_2CH{=}CH_2$ | 3,3,4,4,4-pentafluoro-1-butene |
| HFC-1345mzz | $CHF_2CH{=}CHCF_3$ | 1,1,1,4,4-pentafluoro-2-butene |
| HFC-1345sy | $CH_3CF{=}CFCF_3$ | 1,1,1,2,3-pentafluoro-2-butene |
| HFC-1345fyc | $CH_2{=}CFCF_2CHF_2$ | 2,3,3,4,4-pentafluoro-1-butene |
| HFC-1345pyz | $CHF_2CF{=}CHCHF_2$ | 1,1,2,4,4-pentafluoro-2-butene |
| HFC-1345cyc | $CH_3CF_2CF{=}CF_2$ | 1,1,2,3,3-pentafluoro-1-butene |
| HFC-1345pyy | $CH_2FCF{=}CFCHF_2$ | 1,1,2,3,4-pentafluoro-2-butene |
| HFC-1345eyc | $CH_2FCF_2CF{=}CF_2$ | 1,2,3,3,4-pentafluoro-1-butene |
| HFC-1345ctm | $CF_2{=}C(CF_3)(CH_3)$ | 1,1,3,3,3-pentafluoro-2-methyl-1-propene |
| HFC-1345ftp | $CH_2{=}C(CHF_2)(CF_3)$ | 2-(difluoromethyl)-3,3,3-trifluoro-1-propene |
| HFC1345fye | $CH_2{=}CFCHFCF_3$ | 2,3,4,4,4-pentafluoro-1-butene |
| HFC-1345eyf | $CHF{=}CFCH_2CF_3$ | 1,2,4,4,4-pentafluoro-1-butene |
| HFC-1345eze | $CHF{=}CHCHFCF_3$ | 1,3,4,4,4-pentafluoro-1-butene |
| HFC-1345ezc | $CHF{=}CHCF_2CHF_2$ | 1,3,3,4,4-pentafluoro-1-butene |
| HFC-1345eye | $CHF{=}CFCHFCHF_2$ | 1,2,3,4,4-pentafluoro-1-butene |
| HFC-1354fzc | $CH_2{=}CHCF_2CHF_2$ | 3,3,4,4-tetrafluoro-1-butene |
| HFC-1354ctp | $CF_2{=}C(CHF_2)(CH_3)$ | 1,1,3,3-tetrafluoro-2-methyl-1-propene |
| HFC-1354etm | $CHF{=}C(CF_3)(CH_3)$ | 1,3,3,3-tetrafluoro-2-methyl-1-propene |
| HFC-1354tfp | $CH_2{=}C(CHF_2)_2$ | 2-(difluoromethyl)-3,3-difluoro-1-propene |
| HFC-1354my | $CF_3CF{=}CHCH_3$ | 1,1,1,2-tetrafluoro-2-butene |
| HFC-1354mzy | $CH_3CF{=}CHCF_3$ | 1,1,1,3-tetrafluoro-2-butene |

TABLE 3-continued

| Name | Structure | Chemical name |
|---|---|---|
| FC-141-10myy | $CF_3CF{=}CFCF_2CF_3$ | 1,1,1,2,3,4,4,5,5,5-decafluoro-2-pentene |
| FC-141-10cy | $CF_2{=}CFCF_2CF_2CF_3$ | 1,1,2,3,3,4,4,5,5,5-decafluoro-1-pentene |
| HFC-1429mzt | $(CF_3)_2C{=}CHCF_3$ | 1,1,1,4,4,4-hexafluoro-2-(trifluoromethyl)-2-butene |
| HFC-1429myz | $CF_3CF{=}CHCF_2CF_3$ | 1,1,1,2,4,4,5,5,5-nonafluoro-2-pentene |
| HFC-1429mzy | $CF_3CH{=}CFCF_2CF_3$ | 1,1,1,3,4,4,5,5,5-nonafluoro-2-pentene |
| HFC-1429eyc | $CHF{=}CFCF_2CF_2CF_3$ | 1,2,3,3,4,4,5,5,5-nonafluoro-1-pentene |
| HFC-1429czc | $CF_2{=}CHCF_2CF_2CF_3$ | 1,1,3,3,4,4,5,5,5-nonafluoro-1-pentene |
| HFC-1429cycc | $CF_2{=}CFCF_2CF_2CHF_2$ | 1,1,2,3,3,4,4,5,5-nonafluoro-1-pentene |
| HFC-1429pyy | $CHF_2CF{=}CFCF_2CF_3$ | 1,1,2,3,4,4,5,5,5-nonafluoro-2-pentene |
| HFC-1429myyc | $CF_3CF{=}CFCF_2CHF_2$ | 1,1,1,2,3,4,4,5,5-nonafluoro-2-pentene |
| HFC-1429myye | $CF_3CF{=}CFCHFCF_3$ | 1,1,1,2,3,4,5,5,5-nonafluoro-2-pentene |
| HFC-1429eyym | $CHF{=}CFCF(CF_3)_2$ | 1,2,3,4,4,4-hexafluoro-3-(trifluoromethyl)-1-butene |
| HFC-1429cyzm | $CF_2{=}CFCH(CF_3)_2$ | 1,1,2,4,4,4-hexafluoro-3-(trifluoromethyl)-1-butene |
| HFC-1429mzt | $CF_3CH{=}C(CF_3)_2$ | 1,1,1,4,4,4-hexafluoro-2-(trifluoromethyl)-2-butene |
| HFC-1429czym | $CF_2{=}CHCF(CF_3)_2$ | 1,1,3,4,4,4-hexafluoro-3-(trifluoromethyl)-1-butene |
| HFC-1438fy | $CH_2{=}CFCF_2CF_2CF_3$ | 2,3,3,4,4,5,5,5-octafluoro-1-pentene |
| HFC-1438eycc | $CHF{=}CFCF_2CF_2CHF_2$ | 1,2,3,3,4,4,5,5-octafluoro-1-pentene |
| HFC-1438ftmc | $CH_2{=}C(CF_3)CF_2CF_3$ | 3,3,4,4,4-pentafluoro-2-(trifluoromethyl)-1-butene |
| HFC-1438czzm | $CF_2{=}CHCH(CF_3)_2$ | 1,1,4,4,4-pentafluoro-3-(trifluoromethyl)-1-butene |
| HFC-1438ezym | $CHF{=}CHCF(CF_3)_2$ | 1,3,4,4,4-pentafluoro-3-(trifluoromethyl)-1-butene |
| HFC-1438ctmf | $CF_2{=}C(CF_3)CH_2CF_3$ | 1,1,4,4,4-pentafluoro-2-(trifluoromethyl)-1-butene |
| HFC-1447fzy | $(CF_3)_2CFCH{=}CH_2$ | 3,4,4,4-tetrafluoro-3-(trifluoromethyl)-1-butene |
| HFC-1447fz | $CF_3CF_2CF_2CH{=}CH_2$ | 3,3,4,4,5,5,5-heptafluoro-1-pentene |
| HFC-1447fycc | $CH_2{=}CFCF_2CF_2CHF_2$ | 2,3,3,4,4,5,5-heptafluoro-1-pentene |
| HFC-1447czcf | $CF_2{=}CHCF_2CH_2CF_3$ | 1,1,3,3,5,5,5-heptafluoro-1-pentene |
| HFC-1447mytm | $CF_3CF{=}C(CF_3)(CH_3)$ | 1,1,1,2,4,4,4-heptafluoro-3-methyl-2-butene |
| HFC-1447fyz | $CH_2{=}CFCH(CF_3)_2$ | 2,4,4,4-tetrafluoro-3-(trifluoromethyl)-1-butene |
| HFC-1447ezz | $CHF{=}CHCH(CF_3)_2$ | 1,4,4,4-tetrafluoro-3-(trifluoromethyl)-1-butene |
| HFC-1447qzt | $CH_2FCH{=}C(CF_3)_2$ | 1,4,4,4-tetrafluoro-2-(trifluoromethyl)-2-butene |
| HFC-1447syt | $CH_3CF{=}C(CF_3)_2$ | 2,4,4,4-tetrafluoro-2-(trifluoromethyl)-2-butene |
| HFC-1456szt | $(CF_3)_2C{=}CHCH_3$ | 3-(trifluoromethyl)-4,4,4-trifluoro-2-butene |
| HFC-1456szy | $CF_3CF_2CF{=}CHCH_3$ | 3,4,4,5,5,5-hexafluoro-2-pentene |
| HFC-1456mstz | $CF_3C(CH_3){=}CHCF_3$ | 1,1,1,4,4,4-hexafluoro-2-methyl-2-butene |
| HFC-1456fzce | $CH_2{=}CHCF_2CHFCF_3$ | 3,3,4,5,5,5-hexafluoro-1-pentene |
| HFC-1456ftmf | $CH_2{=}C(CF_3)CH_2CF_3$ | 4,4,4-trifluoro-2-(trifluoromethyl)-1-butene |
| FC-151-12c | $CF_3(CF_2)_3CF{=}CF_2$ | 1,1,2,3,3,4,4,5,5,6,6,6-dodecafluoro-1-hexene (or perfluoro-1-hexene) |
| FC-151-12mcy | $CF_3CF_2CF{=}CFCF_2CF_3$ | 1,1,1,2,2,3,4,5,5,6,6,6-dodecafluoro-3-hexene (or perfluoro-3-hexene) |
| FC-151-12mmtt | $(CF_3)_2C{=}C(CF_3)_2$ | 1,1,1,4,4,4-hexafluoro-2,3-bis(trifluoromethyl)-2-butene |
| FC-151-12mmzz | $(CF_3)_2CFCF{=}CFCF_3$ | 1,1,1,2,3,4,5,5,5-nonafluoro-4-(trifluoromethyl)-2-pentene |
| HFC-152-11mmtz | $(CF_3)_2C{=}CHC_2F_5$ | 1,1,1,4,4,5,5,5-octafluoro-2-(trifluoromethyl)-2-pentene |
| HFC-152-11mmyyz | $(CF_3)_2CFCF{=}CHCF_3$ | 1,1,1,3,4,5,5,5-octafluoro-4-(trifluoromethyl)-2-pentene |
| PFBE (or HFC-1549fz) | $CF_3CF_2CF_2CF_2CH{=}CH_2$ | 3,3,4,4,5,5,6,6,6-nonafluoro-1-hexene (or perfluorobutylethylene) |
| HFC-1549fztmm | $CH_2{=}CHC(CF_3)_3$ | 4,4,4-trifluoro-3,3-bis(trifluoromethyl)-1-butene |
| HFC-1549mmtts | $(CF_3)_2C{=}C(CH_3)(CF_3)$ | 1,1,1,4,4,4-hexafluoro-3-methyl-2-(trifluoromethyl)-2-butene |
| HFC-1549fycz | $CH_2{=}CFCF_2CH(CF_3)_2$ | 2,3,3,5,5,5-hexafluoro-4-(trifluoromethyl)-1-pentene |
| HFC-1549myts | $CF_3CF{=}C(CH_3)CF_2CF_3$ | 1,1,1,2,4,4,5,5,5-nonafluoro-3-methyl-2-pentene |
| HFC-1549mzzz | $CF_3CH{=}CHCH(CF_3)_2$ | 1,1,1,5,5,5-hexafluoro-4-(trifluoromethyl)-2-pentene |
| HFC-1558szy | $CF_3CF_2CF_2CF{=}CHCH_3$ | 3,4,4,5,5,6,6,6-octafluoro-2-hexene |
| HFC-1558fzccc | $CH_2{=}CHCF_2CF_2CF_2CHF_2$ | 3,3,4,4,5,5,6,6-octafluoro-2-hexene |
| HFC-1558mmtzc | $(CF_3)_2C{=}CHCF_2CH_3$ | 1,1,1,4,4-pentafluoro-2-(trifluoromethyl)-2-pentene |
| HFC-1558ftmf | $CH_2{=}C(CF_3)CH_2C_2F_5$ | 4,4,5,5,5-pentafluoro-2-(trifluoromethyl)-1-pentene |
| HFC-1567fts | $CF_3CF_2CF_2C(CH_3){=}CH_2$ | 3,3,4,4,5,5,5-heptafluoro-2-methyl-1-pentene |
| HFC-1567szz | $CF_3CF_2CF_2CH{=}CHCH_3$ | 4,4,5,5,6,6,6-heptafluoro-2-hexene |
| HFC-1567fzfc | $CH_2{=}CHCH_2CF_2C_2F_5$ | 4,4,5,5,6,6,6-heptafluoro-1-hexene |
| HFC-1567sfyy | $CF_3CF_2CF{=}CFC_2H_5$ | 1,1,1,2,2,3,4-heptafluoro-3-hexene |
| HFC-1567fzfy | $CH_2{=}CHCH_2CF(CF_3)_2$ | 4,5,5,5-tetrafluoro-4-(trifluoromethyl)-1-pentene |
| HFC-1567myzzm | $CF_3CF{=}CHCH(CF_3)(CH_3)$ | 1,1,1,2,5,5,5-heptafluoro-4-methyl-2-pentene |
| HFC-1567mmtyf | $(CF_3)_2C{=}CFC_2H_5$ | 1,1,1,3-tetrafluoro-2-(trifluoromethyl)-2-pentene |
| FC-161-14myy | $CF_3CF{=}CFCF_2CF_2C_2F_5$ | 1,1,1,2,3,4,4,5,5,6,6,7,7,7-tetradecafluoro-2-heptene |
| FC-161-14mcyy | $CF_3CF_2CF{=}CFCF_2C_2F_5$ | 1,1,1,2,2,3,4,5,5,6,6,7,7,7-tetradecafluoro-2-heptene |
| HFC-162-13mzy | $CF_3CH{=}CFCF_2CF_2C_2F_5$ | 1,1,1,3,4,4,5,5,6,6,7,7,7-tridecafluoro-2-heptene |
| HFC162-13myz | $CF_3CF{=}CHCF_2CF_2C_2F_5$ | 1,1,1,2,4,4,5,5,6,6,7,7,7-tridecafluoro-2-heptene |
| HFC-162-13mczy | $CF_3CF_2CH{=}CFCF_2C_2F_5$ | 1,1,1,2,2,4,5,5,6,6,7,7,7-tridecafluoro-3-heptene |
| HFC-162-13mcyz | $CF_3CF_2CF{=}CHCF_2C_2F_5$ | 1,1,1,2,2,3,5,5,6,6,7,7,7-tridecafluoro-3-heptene |
| PEVE | $CF_2{=}CFOCF_2CF_3$ | pentafluoroethyl trifluorovinyl ether |
| PMVE | $CF_2{=}CFOCF_3$ | trifluoromethyl trifluorovinyl ether |

The compounds listed in Table 2 and Table 3 are available commercially or may be prepared by processes known in the art or as described herein.

1,1,1,4,4-pentafluoro-2-butene may be prepared from 1,1,1,2,4,4-hexafluorobutane ($CHF_2CH_2CHFCF_3$) by dehydrofluorination over solid KOH in the vapor phase at room temperature. The synthesis of 1,1,1,2,4,4-hexafluorobutane is described in U.S. Pat. No. 6,066,768, incorporated herein by reference.

1,1,1,4,4,4-hexafluoro-2-butene may be prepared from 1,1,1,4,4,4-hexafluoro-2-iodobutane ($CF_3CHICH_2CF_3$) by reaction with KOH using a phase transfer catalyst at about 60° C. The synthesis of 1,1,1,4,4,4-hexafluoro-2-iodobutane may be carried out by reaction of perfluoromethyl iodide ($CF_3I$) and 3,3,3-trifluoropropene ($CF_3CH{=}CH_2$) at about 200° C. under autogenous pressure for about 8 hours.

3,4,4,5,5,5-hexafluoro-2-pentene may be prepared by dehydrofluorination of 1,1,1,2,2,3,3-heptafluoropentane ($CF_3CF_2CF_2CH_2CH_3$) using solid KOH or over a carbon catalyst at 200-300° C. 1,1,1,2,2,3,3-heptafluoropentane may be prepared by hydrogenation of 3,3,4,4,5,5,5-heptafluoro-1-pentene ($CF_3CF_2CF_2CH{=}CH_2$).

1,1,1,2,3,4-hexafluoro-2-butene may be prepared by dehydrofluorination of 1,1,1,2,3,3,4-heptafluorobutane ($CH_2FCF_2CHFCF_3$) using solid KOH.

1,1,1,2,4,4-hexafluoro-2-butene may be prepared by dehydrofluorination of 1,1,1,2,2,4,4-heptafluorobutane ($CHF_2CH_2CF_2CF_3$) using solid KOH.

1,1,1,3,4,4-hexafluoro2-butene may be prepared by dehydrofluorination of 1,1,1,3,3,4,4-heptafluorobutane ($CF_3CH_2CF_2CHF_2$) using solid KOH.

1,1,1,2,4-pentafluoro-2-butene may be prepared by dehydrofluorination of 1,1,1,2,2,3-hexafluorobutane ($CH_2FCH_2CF_2CF_3$) using solid KOH.

1,1,1,3,4-pentafluoro-2-butene may be prepared by dehydrofluorination of 1,1,1,3,3,4-hexafluorobutane ($CF_3CH_2CF_2CH_2F$) using solid KOH.

1,1,1,3-tetrafluoro-2-butene may be prepared by reacting 1,1,1,3,3-pentafluorobutane ($CF_3CH_2CF_2CH_3$) with aqueous KOH at 120° C.

1,1,1,4,4,5,5,5-octafluoro-2-pentene may be prepared from ($CF_3CHICH_2CF_2CF_3$) by reaction with KOH using a phase transfer catalyst at about 60° C. The synthesis of 4-iodo-1,1,1,2,2,5,5,5-octafluoropentane may be carried out by reaction of perfluoroethyliodide ($CF_3CF_2I$) and 3,3,3-trifluoropropene at about 200° C. under autogenous pressure for about 8 hours.

1,1,1,2,2,5,5,6,6,6-decafluoro-3-hexene may be prepared from 1,1,1,2,2,5,5,6,6,6-decafluoro-3-iodohexane ($CF_3CF_2CHICH_2CF_2CF_3$) by reaction with KOH using a phase transfer catalyst at about 60° C. The synthesis of 1,1,1,2,2,5,5,6,6,6-decafluoro-3-iodohexane may be carried out by reaction of perfluoroethyliodide ($CF_3CF_2I$) and 3,3,4,4,4-pentafluoro-1-butene ($CF_3CF_2CH{=}CH_2$) at about 200° C. under autogenous pressure for about 8 hours.

1,1,1,4,5,5,5-heptafluoro-4-(trifluoromethyl)-2-pentene may be prepared by the dehydrofluorination of 1,1,1,2,5,5,5-heptafluoro-4-iodo-2-(trifluoromethyl)-pentane ($CF_3CHICH_2CF(CF_3)_2$) with KOH in isopropanol. $CF_3CHICH_2CF(CF_3)_2$ is made from reaction of $(CF_3)_2CFI$ with $CF_3CH{=}CH_2$ at high temperature, such as about 200° C.

1,1,1,4,4,5,5,6,6,6-decafluoro-2-hexene may be prepared by the reaction of 1,1,1,4,4,4-hexafluoro-2-butene ($CF_3CH{=}CHCF_3$) with tetrafluoroethylene ($CF_2{=}CF_2$) and antimony pentafluoride ($SbF_5$).

2,3,3,4,4-pentafluoro-1-butene may be prepared by dehydrofluorination of 1,1,2,2,3,3-hexafluorobutane over fluorided alumina at elevated temperature.

2,3,3,4,4,5,5,5-ocatafluoro-1-pentene may be prepared by dehydrofluorination of 2,2,3,3,4,4,5,5,5-nonafluoropentane over solid KOH.

1,2,3,3,4,4,5,5-octafluoro-1-pentene may be prepared by dehydrofluorination of 2,2,3,3,4,4,5,5,5-nonafluoropentane over fluorided alumina at elevated temperature.

Many of the compounds of Formula I, Formula II, Table 1, Table 2, and Table 3 exist as different configurational isomers or stereoisomers. When the specific isomer is not designated, the described composition is intended to include all single configurational isomers, single stereoisomers, or any combination thereof. For instance, F11E is meant to represent the E-isomer, Z-isomer, or any combination or mixture of both isomers in any ratio. As another example, HFC-1225ye is meant to represent the E-isomer, Z-isomer, or any combination or mixture of both isomers in any ratio, with the Z isomer preferred.

In some embodiments, the working fluid may further comprise at least one compound selected from hydrofluorocarbons, fluoroethers, hydrocarbons, dimethyl ether (DME), carbon dioxide ($CO_2$), ammonia ($NH_3$), and iodotrifluoromethane ($CF_3I$).

In some embodiments, the working fluid may further comprise hydrofluorocarbons comprising at least one saturated compound containing carbon, hydrogen, and fluorine. Of particular utility are hydrofluorocarbons having 1 to 7 carbon atoms and having a normal boiling point of from about −90° C. to about 80° C. Hydrofluorocarbons are commercial products available from a number of sources or may be prepared by methods known in the art. Representative hydrofluorocarbon compounds include but are not limited to fluoromethane ($CH_3F$, HFC-41), difluoromethane ($CH_2F_2$, HFC-32), trifluoromethane ($CHF_3$, HFC-23), pentafluoroethane ($CF_3CHF_2$, HFC-125), 1,1,2,2-tetrafluoroethane ($CHF_2CHF_2$, HFC-134), 1,1,1,2-tetrafluoroethane ($CF_3CH_2F$, HFC-134a), 1,1,1-trifluoroethane ($CF_3CH_3$, HFC-143a), 1,1-difluoroethane ($CHF_2CH_3$, HFC-152a), fluoroethane ($CH_3CH_2F$, HFC-161), 1,1,1,2,2,3,3-heptafluoropropane ($CF_3CF_2CHF_2$, HFC-227ca), 1,1,1,2,3,3,3-heptafluoropropane ($CF_3CHFCF_3$, HFC-227ea), 1,1,2,2,3,3-hexafluoropropane ($CHF_2CF_2CHF_2$, HFC-236ca), 1,1,1,2,2,3-hexafluoropropane ($CF_3CF_3CH_2F$, HFC-236cb), 1,1,1,2,3,3-hexafluoropropane ($CF_3CHFCHF_2$, HFC-236ea), 1,1,1,3,3,3-hexafluoropropane ($CF_3CH_2CF_3$, HFC-236fa), 1,1,2,2,3-pentafluoropropane ($CHF_2CF_2CH_2F$, HFC-245ca), 1,1,1,2,2-pentafluoropropane ($CF_3CF_2CH_3$, HFC-245cb), 1,1,2,3,3-pentafluoropropane ($CHF_2CHFCHF_2$, HFC-245ea), 1,1,1,2,3-pentafluoropropane ($CF_3CHFCH_2F$, HFC-245eb), 1,1,1,3,3-pentafluoropropane ($CF_3CH_2CHF_2$, HFC-245fa), 1,2,2,3-tetrafluoropropane ($CH_2FCF_2CH_2F$, HFC-254ca), 1,1,2,2-tetrafluoropropane ($CHF_2CF_2CH_3$, HFC-254cb), 1,1,2,3-tetrafluoropropane ($CHF_2CHFCH_2F$, HFC-254ea), 1,1,1,2-tetrafluoropropane ($CF_3CHFCH_3$, HFC-254eb), 1,1,3,3-tetrafluoropropane ($CHF_2CH_2CHF_2$, HFC-254fa), 1,1,1,3-tetrafluoropropane ($CF_3CH_2CH_2F$, HFC-254fb), 1,1,1-trifluoropropane ($CF_3CH_2CH_3$, HFC-263fb), 2,2-difluoropropane ($CH_3CF_2CH_3$, HFC-272ca), 1,2-difluoropropane ($CH_2FCHFCH_3$, HFC-272ea), 1,3-difluoropropane ($CH_2FCH_2CH_2F$, HFC-272fa), 1,1-difluoropropane ($CHF_2CH_2CH_3$, HFC-272fb), 2-fluoropropane ($CH_3CHFCH_3$, HFC-281ea), 1-fluoropropane ($CH_2FCH_2CH_3$, HFC-281fa), 1,1,2,2,3,3,4,4-octafluorobutane ($CHF_2CF_2CF_2CHF_2$, HFC-338pcc), 1,1,1,2,2,4,4,4-octafluorobutane ($CF_3CH_2CF_2CF_3$, HFC-338mf), 1,1,1,3,3-pentafluorobutane ($CF_3CH_2CHF_2$, HFC-365mfc), 1,1,1,2,3,4,4,5,5,5-decafluoropentane ($CF_3CHFCHFCF_2CF_3$, HFC-43-10mee), and 1,1,1,2,2,3,4,5,5,6,6,7,7,7-tetradecafluoroheptane ($CF_3CF_2CHFCHFCF_2CF_2CF_3$, HFC-63-14mee).

In some embodiments, working fluids may further comprise fluoroethers comprising at least one compound having carbon, fluorine, oxygen and optionally hydrogen, chlorine, bromine or iodine. Fluoroethers are commercially available or may be produced by methods known in the art. Representative fluoroethers include but are not limited to nonafluoromethoxybutane ($C_4F_9OCH_3$, any or all possible isomers or mixtures thereof); nonafluoroethoxybutane ($C_4F_9OC_2H_5$, any or all possible isomers or mixtures thereof); 2-difluoromethoxy-1,1,1,2-tetrafluoroethane (HFOC-236eaEβγ, or $CHF_2OCHFCF_3$); 1,1-difluoro-2-methoxyethane (HFOC-272fbEβγ, □$CH_3OCH_2CHF_2$); 1,1,1,3,3,3-hexafluoro-2-(fluoromethoxy)propane (HFOC-347mmzEβγ, or $CH_2FOCH(CF_3)_2$); 1,1,1,3,3,3-hexafluoro-2-methoxypropane (HFOC-356mmzEβγ, or $CH_3OCH(CH_3)_2$); 1,1,1,2,2-pentafluoro-3-methoxypropane (HFOC-365mcEγδ, or $CF_3CF_2CH_2OCH_3$); 2-ethoxy-1,1,1,2,3,3,3-heptafluoropropane (HFOC-467mmyEβγ, or $CH_3CH_2OCF(CF_3)_2$ and mixtures thereof.

In some embodiments, working fluids may further comprise hydrocarbons comprising compounds having only carbon and hydrogen. Of particular utility are compounds having 3 to 7 carbon atoms. Hydrocarbons are commercially available through numerous chemical suppliers. Representative hydrocarbons include but are not limited to propane, n-butane, isobutane, cyclobutane, n-pentane, 2-methylbutane, 2,2-dimethylpropane, cyclopentane, n-hexane, 2-methylpentane, 2,2-dimethylbutane, 2,3-dimethylbutane, 3-methylpentane, cyclohexane, n-heptane, and cycloheptane.

In some embodiments, the working fluid may comprise hydrocarbons containing heteroatoms, such as dimethylether (DME, $CH_3OCH_3$). DME is commercially available.

In some embodiments, working fluids may further comprise carbon dioxide ($CO_2$), which is commercially available from various sources or may be prepared by methods known in the art.

In some embodiments, working fluids may further comprise ammonia ($NH_3$), which is commercially available from various sources or may be prepared by methods known in the art.

In some embodiments, the working fluid further comprises at least one compound selected from hydrofluorocarbons, fluoroethers, hydrocarbons, dimethyl ether (DME), carbon dioxide ($CO_2$), ammonia ($NH_3$), and iodotrifluoromethane ($CF_3I$).

In one embodiment, the working fluid comprises 1,2,3,3,3-pentafluoropropene (HFC-1225ye). In another embodiment, the working fluid further comprises difluoromethane (HFC-32). In yet another embodiment, the working fluid further comprises 1,1,1,2-tetrafluoroethane (HFC-134a).

In one embodiment, the working fluid comprises 2,3,3,3-tetrafluoropropene (HFC-1234yf). In another embodiment, the working fluid comprises HFC-1225ye and HFC-1234yf.

In one embodiment, the working fluid comprises 1,3,3,3-tetrafluoropropene (HFC-1234ze). In another embodiment, the working fluid comprises E-HFC-1234ze (or trans-HFC-1234ze).

In yet another embodiment, the working fluid further comprises at least one compound from the group consisting of HFC-134a, HFC-32, HFC-125, HFC-152a, and $CF_3I$.

In certain embodiments, working fluids may comprise a composition selected from the group consisting of:

HFC-32 and HFC-1225ye;
HFC-1234yf and $CF_3I$;
HFC-32, HFC-134a, and HFC-1225ye;
HFC-32, HFC-125, and HFC-1225ye;
HFC-32, HFC-1225ye, and HFC-1234yf;
HFC-125, HFC-1225ye, and HFC-1234yf;
HFC-32, HFC-1225ye, HFC-1234yf, and $CF_3I$;
HFC-134a, HFC-1225ye, and HFC-1234yf;
HFC-134a and HFC-1234yf;
HFC-32 and HFC-1234yf;
HFC-125 and HFC-1234yf;
HFC-32, HFC-125, and HFC-1234yf;
HFC-32, HFC-134a, and HFC-1234yf;
DME and HFC-1234yf;
HFC-152a and HFC-1234yf;
HFC-152a, HFC-134a, and HFC-1234Yf;
HFC-152a, n-butane, and HFC-1234yf;
HFC-134a, propane, and HFC-1234yf;
HFC-125, HFC-152a, and HFC-1234yf;
HFC-125, HFC-134a, and HFC-1234yf;
HFC-32, HFC-1234ze, and HFC-1234yf;
HFC-125, HFC-1234ze, and HFC-1234yf;
HFC-32, HFC-1234ze, HFC-1234yf, and $CF_3I$;
HFC-134a, HFC-1234ze, and HFC-1234yf;
HFC-134a and HFC-1234ze;
HFC-32 and HFC-1234ze;
HFC-125 and HFC-1234ze;
HFC-32, HFC-125, and HFC-1234ze;
HFC-32, HFC-134a, and HFC-1234ze;
DME and HFC-1234ze;
HFC-152a and HFC-1234ze;
HFC-152a, HFC-134a, and HFC-1234ze;
HFC-152a, n-butane, and HFC-1234ze;
HFC-134a, propane, and HFC-1234ze;
HFC-125, HFC-152a, and HFC-1234ze; or
HFC-125, HFC-134a, and HFC-1234ze.

EXAMPLES

Example 1

Performance Comparison

Automobile air conditioning systems with and without an intermediate heat exchanger are tested to determine if an improvement is seen with the IHX. The working fluid is a blend of 95% by weight HFC-1225ye and 5% by weight of HFC-32. Each system has a condenser, evaporator, compressor and a thermal expansion device. The ambient air temperature is 30° C. at the evaporator and the condenser inlets. Tests are performed for 2 compressor speeds, 1000 and 2000 rpm, and for 3 vehicle speeds: 25, 30, and 36 km/h. The volumetric flow rate of air on the evaporator is 380 $m^3/h$.

The cooling capacity for the system with an IHX shows an increase of 4 to 7% as compared to the system with no IHX. The COP also shows an increase of 2.5 to 4% for the system with the IHX as compared to a system with no IHX.

Example 2

Improvement in Performance with Internal Heat Exchanger

Cooling performance is calculated for HFC-134a and HFC-1234yf both with and without an IHX. The conditions used are as follows:

| | |
|---|---|
| Condenser temperature | 55° C. |
| Evaporator temperature | 5° C. |
| Superheat (absolute) | 15° C. |

The data illustrating relative performance is shown in TABLE 5.

TABLE 5

| Test | Subcool, ° C. | COP | Capacity kJ/m$^3$ | Compressor work, kJ/kg |
|---|---|---|---|---|
| HFC-134a, without IHX | 0 | 4.74 | 2250.86 | 29.6 |
| HFC-134a, with IHX | 5.0 | 5.02 | 2381.34 | 29.6 |
| HFC-134a, % increase with IHX | | 5.91 | 5.80 | |
| HFC-134yf, without IHX | 0 | 4.64 | 2172.43 | 24.37 |
| HFC-134yf, with IHX | 5.8 | 5.00 | 2335.38 | 24.37 |
| HFC-134yf, % increase with IHX | | 7.76 | 7.50 | |

The data above demonstrate an unexpected level of improvement in energy efficiency (COP) and cooling capacity for the fluoroolefin (HFC-1234yf) with the IHX, as compared to that gained by HFC-134a with the IHX. In particular, COP is increased by 7.67% and cooling capacity is increased by 7.50%.

It should be noted that the subcool difference arises from the differences in molecular weight, liquid density and liquid heat capacity for HFC-1234yf as compared to HFC-134a. Based on these parameters it is estimated that there would be a difference in subcool achieved with the different compounds. When the HFC-134a subcool is set to 5° C., the corresponding subcool for HFC-1234yf is calculated to be 5.8° C.

What is claimed is:

1. A vapor compression heat transfer system, comprising:

a. a closed circulation loop containing a fluoroolefin working fluid composition for circulation therein, said loop at least comprising, in fluid communication, a dual-row evaporator, a compressor, a dual row condenser, and an intermediate heat exchanger (IHX), (i) said dual-row evaporator comprising, a front row and a back row, (a) said front and back rows respectively having a first and a second set of discrete, serially connected tanks arranged to provide countercurrent flow along a first axis, a first tank of said first set has a feed end with an inlet, and a second tank of said second set has a discharge end with an outlet, and (b) a collector arranged along a fourth axis orthogonal to said first axis and fluidly connecting a second tank of said first set with a first tank of said second tank to convey fluoroolefin working fluid from said front to said back row;

(ii) said dual-row condenser having:

(a) a back row having a first manifold for receiving and distributing the fluoroolefin working fluid to a plurality of channels for conveying the fluoroolefin working fluid to a downstream second manifold in only a first direction along a third axis, and (b) a front row comprising first, second and third sections connected for serial flow, a first one said sections located at an upper portion of said front row providing flow only in a second direction opposite to said first direction, an intermediate section providing flow in only a third countercurrent direction, and a distal subcooling section located at a lower portion of said front row providing flow in only said second direction and having an outlet for discharging subcooled fluoroolefin working fluid, wherein each section of said front row comprises a plurality of tubes; and b) said IHX comprising:

i. a first tube having an inlet connected to said outlet of said subcooling section of said condenser, and an outlet connected to and in flow communication with said feed end inlet of said first tank, and ii. a second tube having an inlet connected to said outlet at said discharge end, and an outlet connected to said compressor inlet, wherein said first and second tubes of said IHX are in thermal contact with one another.

2. The system of claim 1 wherein each section of said condenser is configured as a tube and fin condenser, and each of said channels is formed by a tube.

3. The system of claim 1 wherein said vapor compression system comprises a stationary refrigeration system, an air-conditioning system, a heat pump system, a mobile air-conditioning systems and a refrigeration systems.

4. The system of claim 3 wherein the compressor comprises one of reciprocating, rotary, jet, centrifugal, scroll, screw and axial-flow compressors.

5. The system of claim 1 wherein first and second tubes of said IHX are arranged to provide flow in opposite directions.

6. The system of claim 5 wherein the first and second tubes of said IHX are concentrically arranged.

7. A process for operating the system of any of claims 2-4 and 1 comprising continually circulating said fluoroolefin working fluid composition serially to and through the dual-row evaporator, the IHX, the compressor, the dual row condenser which sub-cools said fluoroolefin working fluid composition prior to feeding to and through said IHX, and back to and through said dual row evaporator.

8. The process of claim 7 wherein the dual-row condenser provides sub cooled fluoroolefin working fluid to said IHX.

9. The process of claim 7 wherein circulating said fluoroolefin working fluid composition to and through said dual-row condenser further comprises introducing said fluoroolefin working fluid composition through said first inlet of said back row of said dual row condenser at a first temperature and discharging cooled said fluoroolefin working fluid composition to said front row of said dual-row condenser at a second lower temperature, and discharging said fluoroolefin working fluid composition from said front row at a third and sub-cooled lower temperature to be circulated to said IHX.

10. The process of claim 7 further comprises passing air sequentially across the front and then back rows of the dual-row condenser to preheat the air.

11. The system of any of claims 2, 3-4 and 1 wherein the fluoroolefin working fluid composition comprises one of:

a) HFC-32 and HFC-1225ye;
b) HFC-1234yf and CF3 I;
c) HFC-32, HFC-134a, and HFC-1225ye;
d) HFC-32, HFC-125, and HFC-1225ye;
e) HFC-32, HFC-1225ye, and HFC-1234yf;
f) HFC-125, HFC-1225ye, and HFC-1234yf;
g) HFC-32, HFC-1225ye, HFC-1234yf, and CF3 I;
h) HFC-134a, HFC-1225ye, and HFC-1234yf;
i) HFC-134a and HFC-1234yf;
j) HFC-32 and HFC-1234yf;
k) HFC-125 and HFC-1234yf;
l) HFC-32, HFC-125, and HFC-1234yf;
m) HFC-32, HFC-134a, and HFC-1234yf;
n) DME and HFC-1234yf;

o) HFC-152a and HFC-1234yf; and p) HFC-152a, HFC-134a, and HFC-1234yf.

12. The process of claim 7 wherein the fluoroolefin working fluid composition comprises one of:

a) HFC-32 and HFC-1225ye;

b) HFC-1234yf and CF3 I;

c) HFC-32, HFC-134a, and HFC-1225ye;

d) HFC-32, HFC-125, and HFC-1225ye;

e) HFC-32, HFC-1225ye, and HFC-1234yf;

f) HFC-125, HFC-1225ye, and HFC-1234yf;

g) HFC-32, HFC-1225ye, HFC-1234yf, and CF3 I;

h) HFC-134a, HFC-1225ye, and HFC-1234yf;

i) HFC-134a and HFC-1234yf;

j) HFC-32 and HFC-1234yf;

k) HFC-125 and HFC-1234yf;

l) HFC-32, HFC-125, and HFC-1234yf;

m) HFC-32, HFC-134a, and HFC-1234yf;

n) DME and HFC-1234yf;

o) HFC-152a and HFC-1234yf; and p) HFC-152a, HFC-134a, and HFC-1234yf.

13. The system of claim 11 wherein the fluoroolefin working fluid composition comprises one of:

a) HFC-1234yf and CF3I;

b) HFC-32, HFC-1225ye, and HFC-1234yf;

c) HFC-125, HFC-1225ye, and HFC-1234yf;

d) HFC-32, HFC-1225ye, HFC-1234yf, and CF3 I;

e) HFC-134a, HFC-1225ye, and HFC-1234yf;

f) HFC-134a and HFC-1234yf;

g) HFC-32 and HFC-1234yf;

h) HFC-125 and HFC-1234yf;

i) HFC-32, HFC-125, and HFC-1234yf;

j) HFC-32, HFC-134a, and HFC-1234yf;

k) DME and HFC-1234yf;

l) HFC-152a and HFC-1234yf; and m) HFC-152a, HFC-134a, and HFC-1234yf.

14. The process of claim 12 wherein the fluoroolefin working fluid composition comprises one of:

a) HFC-32 and HFC-1225ye;

b) HFC-1234yf and CF3I;

c) HFC-32, HFC-1225ye, and HFC-1234yf;

d) HFC-125, HFC-1225ye, and HFC-1234yf;

e) HFC-32, HFC-1225ye, HFC-1234yf, and CF3 I;

f) HFC-134a, HFC-1225ye, and HFC-1234yf;

g) HFC-134a and HFC-1234yf;

h) HFC-32 and HFC-1234yf;

i) HFC-125 and HFC-1234yf;

j) HFC-32, HFC-125, and HFC-1234yf;

k) HFC-32, HFC-134a, and HFC-1234yf;

l) DME and HFC-1234yf;

m) HFC-152a and HFC-1234yf; and n) HFC-152a, HFC-134a, and HFC-1234yf.

15. The process of claim 7 wherein said system comprises a vapor compression system of a stationary refrigeration system, an air-conditioning system, a heat pump system, a mobile air-conditioning systems and a refrigeration systems.

16. The process of claim 15 wherein said system comprises a vapor compression system of a heat pump system.

17. The process of claim 15 wherein said system comprises a vapor compression system of a mobiles heat pump or air conditioning system.

18. The system of claim 1 wherein the closed loop further comprises one of an expansion valve, a capillary tube and an orifice tube upstream of arranged upstream said front row inlet of said evaporator.

19. The process of claim 7 wherein said fluoroolefin working fluid composition from that IHX passes through one of an expansion valve, a capillary tube and an orifice tube prior to passing to said front row inlet of said evaporator.

20. The system of claim 1 wherein said fluoroolefin working fluid composition comprises compounds with 3 to 7 carbon.

21. The process of claim 7 wherein said fluoroolefin working fluid composition comprises compounds with 3 to 7 carbon atoms.

* * * * *